US006176282B1

(12) United States Patent
Nakamura et al.

(10) Patent No.: US 6,176,282 B1
(45) Date of Patent: Jan. 23, 2001

(54) APPARATUS AND METHOD FOR CENTERING AND FEEDING LOG

(75) Inventors: Tsuyoshi Nakamura; Shunichi Suzuki, both of Aichi (JP)

(73) Assignee: Meinan Machinery Works, Inc., Obu (JP)

( * ) Notice: Under 35 U.S.C. 154(b), the term of this patent shall be extended for 0 days.

(21) Appl. No.: 09/344,243

(22) Filed: Jun. 25, 1999

(30) Foreign Application Priority Data

Jun. 26, 1998 (JP) ..... 10-180845

(51) Int. Cl.[7] ..... B27L 5/02; B27B 1/00

(52) U.S. Cl. ..... 144/215.2; 144/209.1; 144/357; 144/400; 144/365; 700/160; 700/167

(58) Field of Search ..... 144/209.1, 211, 144/212, 213, 356, 357, 362, 365, 408; 700/160, 167; 702/169, 167

(56) References Cited

U.S. PATENT DOCUMENTS 4,383,560 * 5/1983 McGee ..... 144/215.2
4,889,605 * 12/1989 Ely ..... 144/215.2
5,449,030 9/1995 Mutsuura et al. ..... 144/357
5,582,224 * 12/1996 Mutsuura et al. ..... 144/357

* cited by examiner

*Primary Examiner*—W. Donald Bray
(74) *Attorney, Agent, or Firm*—Armstrong, Westerman, Hattori, McLeland & Naughton

(57) ABSTRACT

A pair of centering spindles are disposed away from cutting spindles and movably in the direction of Z or parallel with the axial center line of cutting spindles. A plurality of log center detecting means are disposed along the Z direction in relative to a log chucked by the centering spindles. A pair of holding members are mounted movably in the directions of X, Z, and Y including components orthogonally intersecting the X and Z. By way of controlling means, the centering spindle holding a log is caused to rotate at least one revolution thereby enabling the log center detecting means to determine each position of axial center which is assumed to constitute the axial centers at both end faces of the log, the virtual line passing through every positions of axial centers in Z direction is aligned with the Y, and the holding members are moved in the Z direction to hold the log, after which the chucking of log by the centering spindles are released. The holding members are moved in the X direction toward the cutting spindle, as well as in the Y direction to align every axial centers with the rotational center of cutting spindles, thus allowing the log to be chucked by the cutting spindle.

18 Claims, 23 Drawing Sheets

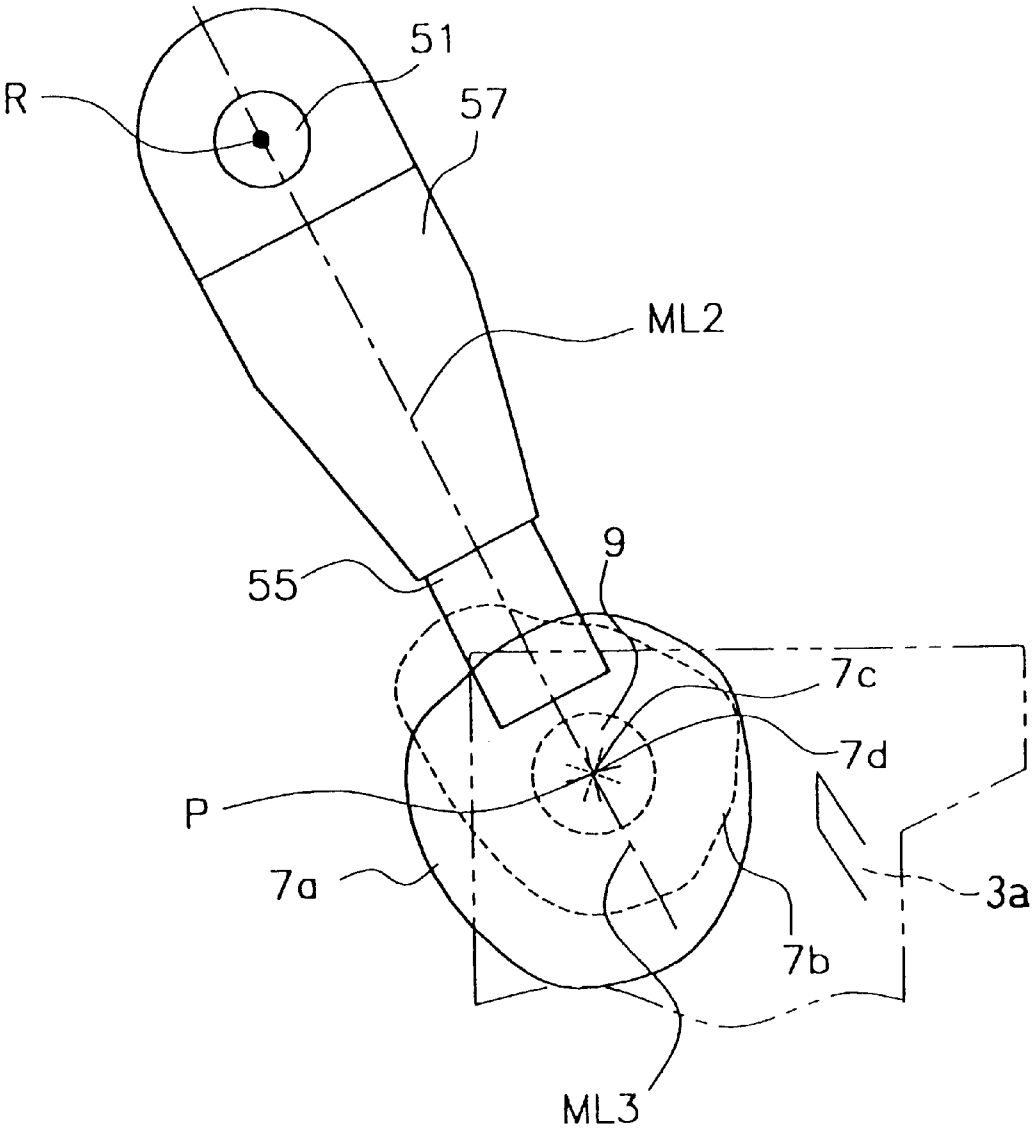
FIG. 17
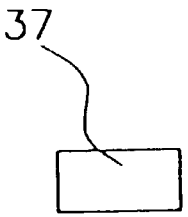

APPARATUS AND METHOD FOR CENTERING AND FEEDING LOG

BACKGROUND OF THE INVENTION

This invention relates to an apparatus for centering and feeding a log and to a method for centering and feeding a log, which are adapted to be used in combination with a working machine for turning a log while chucking the log by means of cutting spindles.

There is known a veneer lathe provided with cutting spindles having, in the direction of Z thereof, an axial center for chucking a log to be cut or peeled into a monolithic veneer (hereinafter referred simply to as a veneer). There is also known an apparatus for centering and feeding a log (or a log centering and feeding apparatus), which is designed to feed a log to the cutting spindles of the veneer lathe in such a manner that the log can be properly centered.

FIG. 23 shows part of one example of the conventional log centering and feeding apparatus which is disclosed in Japanese Patent Unexamined Publication H4-60001, wherein one side portion of the log-chucking section of the apparatus is illustrated. According to this log centering and feeding apparatus, a pair of centering spindles 100 (only one of them is shown) having an axial center in the same Z direction as that of the cutting spindles (not shown) of the veneer lathe are disposed away from the cutting spindles by a predetermined distance in the direction of X. The centering spindles 100 are mounted on a guiding shaft 103 which is horizontally interposed between a pair of frames 101 erected vertically (in the direction of Y), and the position of centering spindles 100 is made adjustable by means of an X-axis adjustor comprising a fluid cylinder (not shown), etc. A pair of transporting claws 104 (only one of them is shown) are disposed over the centering spindles 100 in such a manner that the position of each of the transporting claws 104 can be adjusted in the vertical direction (in the direction of Y) by means of a Y-axis adjustor comprising a fluid cylinder 105, etc. and the transporting claws 104 are made entirely movable along the rail 110 or in the direction of X toward the cutting spindles of the veneer lathe.

Further, a plurality of log center detecting means each provided with a displacement detector 121 for detecting the position of center of a log (not shown) while the log is being kept chucked by the centering spindle 100 is mounted on a proximal end of each rocking arm 120 which is positioned at a desired interval along the longitudinal direction (in the direction of Z) of the log. In this case, the centering spindle 100 holding the log is rotated at least one revolution thereby enabling each log center detecting means to determine, through processing, each position of axial center which is assumed to constitute the axial centers at both end faces of the log, thus obtaining coordinate values on the axial center throughout the full length of log, on the basis of which the pair of centering spindles 100 are respectively shifted along the horizontal guiding shaft 103 by making use of the X-axis adjustor thereby performing the positional correction in the direction of X. Thereafter, each of the transporting claws 104 is moved downward to a predetermined degree so as to allow the log (that has been determined regarding the positional correction in the direction of X) to be held using the transporting claws 104, after which the log is moved in the vertical direction (in the direction of Y) up to a predetermined position by making use of the Y-axis adjustor (comprising the fluid cylinder 105), thereby performing the positional correction in the direction of Y. After finishing the alignment of axial center of log in both X and Y directions, the transporting claws 104 is moved, while maintaining this state of log. in the direction of X toward the cutting spindle of the veneer lathe so as to transfer the log to the cutting spindle.

As described above, according to the conventional log centering device, the adjustment data is output to the X-axis adjustor as well as to the Y-axis adjustor on the basis of data of axial center of log which have been obtained through the processing of data obtained from the displacement detector and from the rotation angle detector, whereby the log is shifted in the directions of X-axis and Y-axis so as to make the axial center of the log agree or align with the cutting spindle, thus performing the centering of the log.

However, since the aforementioned conventional centering device requires not only the X-axis adjustor for moving the holding claw (centering spindle 100) in the direction of X-axis but also the Y-axis adjustor for moving the transporting claw 104 in the direction of Y-axis, the log centering device itself inevitably becomes large in size and at the same time, becomes complicated in structure, thus inviting an increase in cost.

BRIEF SUMMARY OF THE INVENTION

The present invention has been accomplished with a view to overcome the aforementioned drawbacks of the prior art, and therefore, the object of the present invention is to provide an apparatus and a method for centering and feeding a log, which are capable of omitting the aforementioned exclusive X-axis adjustor, capable of miniaturizing the apparatus, and capable of simplifying the structure of the apparatus, thus making it possible to save the manufacturing cost of the apparatus.

With a view to achieve the aforementioned problems, the present invention provides a log centering and feeding apparatus which is fundamentally featured in that a reference virtual line in the direction of Y is set in a pair of log transporting members which correspond to the aforementioned transporting claw 104, in that the centering spindle holding a log is rotated at least one revolution thereby enabling each log center detecting means to determine, through processing, each position of axial center which is assumed to constitute the axial centers at both end faces of the log, and in that the centering spindle is further rotated so as to render the direction of the virtual line passing through every positions of axial centers as viewed from the aforementioned direction of Z to align with the reference virtual line that has been set in advance to the pair of the log transporting members, thus making it possible to omit the X-axis adjustor comprising the fluid cylinder, etc. which is provided in the conventional log centering apparatus.

The means for further rotating the centering spindle so as to render the direction of the virtual line passing through every positions of axial centers as viewed from the direction of Z to align with the reference virtual line that has been set in advance to the pair of the log transporting members can be substituted by making use of a centering spindle-rotating means that has been attached in advance to the log centering and feeding apparatus, so that any additional device is not required, thus making it possible to miniaturize the apparatus and to simplify the construction of the apparatus.

Namely, the present invention provides a log centering and feeding apparatus which is designed to be employed in combination with a veneer lathe provided at least with a cutting spindle having an axial center in the direction of Z for chucking a log constituting a raw material for producing a veneer, said log centering and feeding apparatus being used for feeding the log to the cutting spindle under a condition where the centering of the log has been determined, and comprising a centering spindle disposed away from the cutting spindle by a predetermined distance in the direction of X and having an axial center in the same Z direction as that of said cutting spindle, log center detecting means for detecting the position of axial center of the log under a condition where the log is kept chucked by said centering spindle, a pair of log transporting members which are rendered movable in the direction of Z as well as in the direction of Y including a component orthogonally intersecting the direction of Z thereby enabling the log transporting members to receive the log from said centering spindle and to deliver the log to said cutting spindle, and control means for controlling the operation of each log transporting member; wherein said log transporting members are provided with a setting of reference virtual line in the direction of Y; and said control means comprises means for forcing the centering spindle holding the log to rotate at least one revolution thereby enabling said log center detecting means to determine, through processing, each position of axial center which is assumed to constitute the axial centers at both end faces of the log, means for further rotating the centering spindle so as to make the direction of the virtual line passing through every positions of axial centers as viewed from the direction of Z agree or parallel with the reference virtual line that has been set in advance to the pair of the log transporting members, means for controlling said pair of log transporting members, after the log has been transferred from said centering spindle to said log transporting members while maintaining the directions of said virtual lines in agreement or parallel with each other, in such a manner that each center position of the log that has already been kept in place in the direction of X where the virtual line passing through said axial center of the log is made in agreement with the axial center line of said cutting spindle can be made in agreement with the direction of z constituting the axial center line of said cutting spindle, and means for controlling said log transporting members in a manner to allow said log to be chucked from said log transporting members to said cutting spindle while the state of the log adjusted in the direction of z is maintained. As a result of the aforementioned structure, it is possible to feed the log in an axially centered state thereof to the cutting spindle.

Although the log transporting members may be entirely constituted by a single member, it is more preferable that they comprise a pair of holders which are movable in the direction of Z, and a holding member mounted on the holder which is movable in the direction of Z and being made movable in the direction of the reference virtual line in relative to the holder movable in the direction of Z. It is possible with this preferable embodiment to increase the degree of freedom in designing the log transporting members and the log centering and feeding apparatus. In this case, the aforementioned reference virtual line may be set on the basis of these holding members.

Further, the log transporting members may be allowed to move linearly and reciprocatively in the direction of X, or to rotate about any desired point.

The present invention also provides a method of centering and feeding a log, which comprises the steps of:

determining, through processing by making use of log center detecting means, each position of axial center which is assumed to constitute the axial centers at both end faces of the log by forcing the centering spindle to rotate at least one revolution while both ends of the log are kept chucked with a pair of centering spindles;

further rotating the pair of centering spindles until the virtual line passing through the positions of axial centers as viewed from the direction of Z parallel with the axial center line of the centering spindle is aligned with a predetermined position in the direction of Y;

moving a pair of holding members in the direction of Z and close to both end faces of the log thereby to hold the log with the holding members;

moving said centering spindles away from each end face of the log;

integrally moving said pair of holding members in the direction of X including a directional component extending from said centering spindle to said cutting spindle of veneer lathe until the log is chucked by said cutting spindle; and moving said holding members respectively in the direction of Y thereby rendering each position of axial center at both end faces of the log to become in agreement with the rotational center of said cutting spindle of veneer lathe.

By the way, the expression of "axial center line" means a virtual line passing through the rotational centers of a rotational body, i.e. a virtual line passing through the rotational center of each cross-section intersecting orthogonally with the longitudinal direction of a rotational body.

BRIEF DESCRIPTION OF THE SEVERAL VIEWS OF THE DRAWING

FIG. 17 is an enlarged front view illustrating a centering and feeding mechanism;

DETAILED DESCRIPTION OF THE INVENTION

This invention will be further explained with reference various embodiments of this invention.

Embodiment 1

Figure 1:
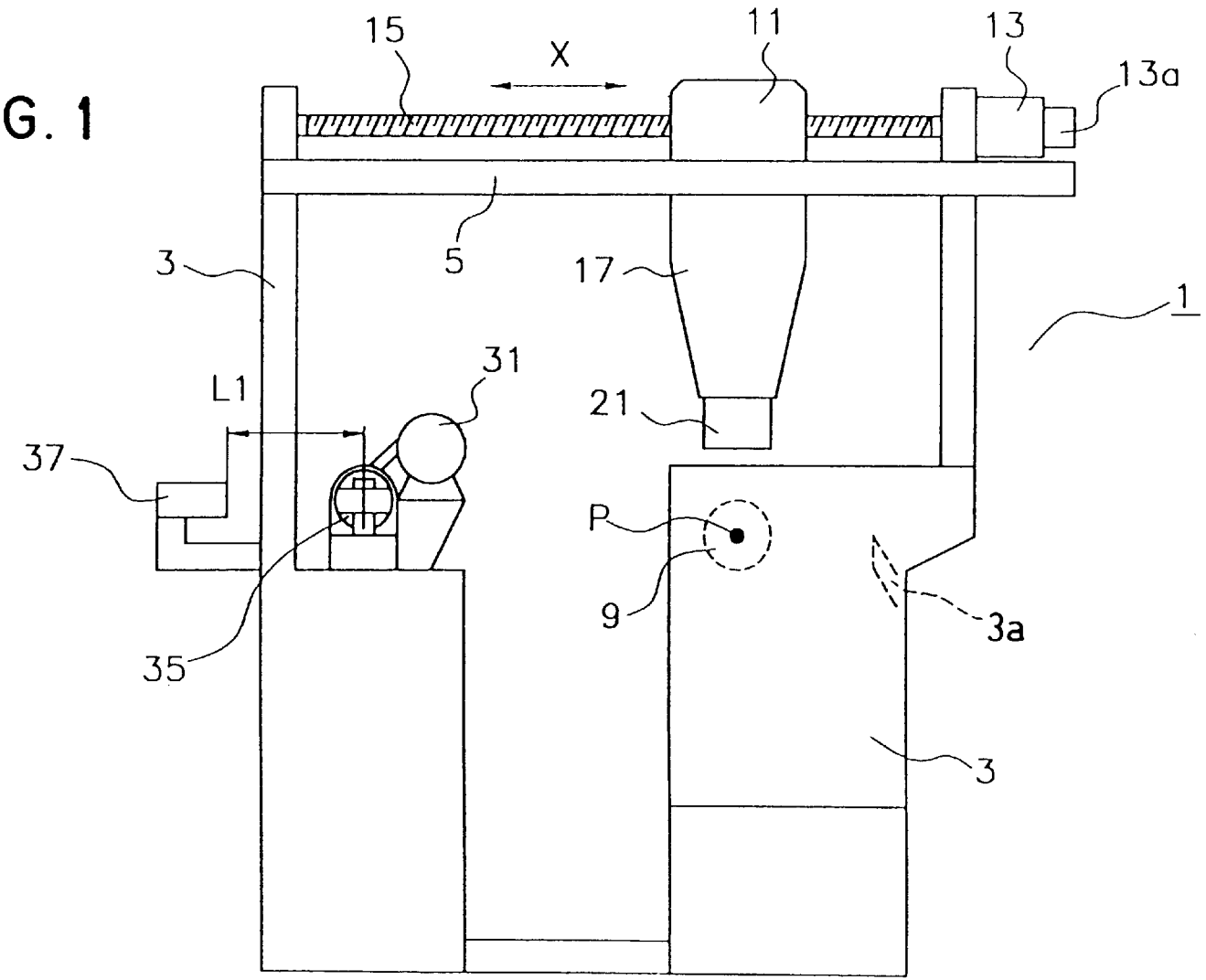
FIG. 1 is a front view schematically showing one example of a log centering apparatus including a veneer lathe according to the present invention.
Figure 2:
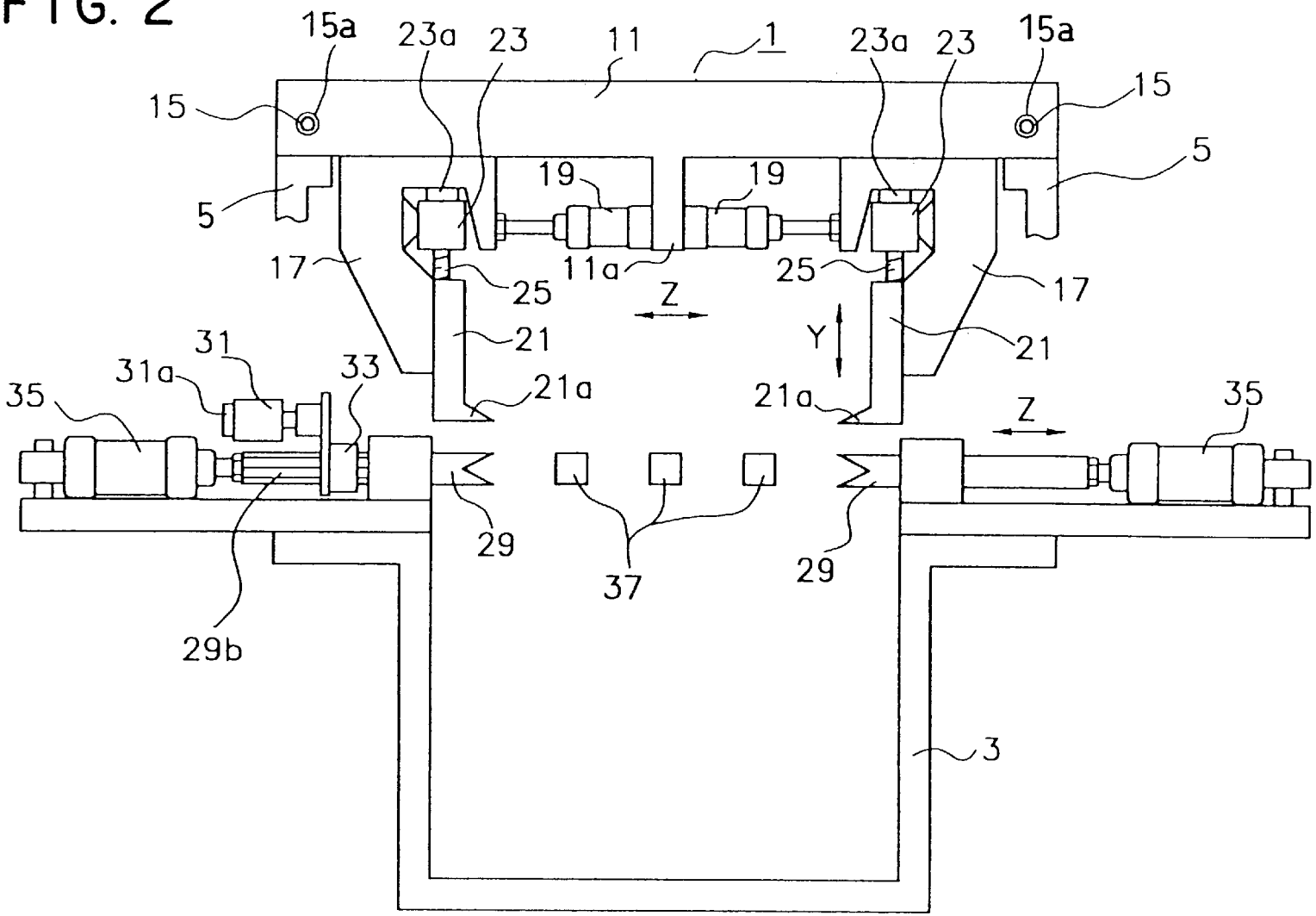
FIG. 2 is a side view as viewed from the left side of FIG. 1.

FIG. 1 is a front view schematically showing a log centering apparatus including a veneer lathe. FIG. 2 is a side view as viewed from the left side of FIG. 1

Referring to these FIGS. , a veneer lathe 1 is constructed in the same manner as that of the conventional lathe, and comprises a frame 3 on which a cutter 3*a* for peeling (or cutting) a log 7 (see FIG. 4, etc.) to produce a veneer, and a pair of cutting spindles 9 for chucking and rotating the log 7 are mounted. At the portions of the frame 3 located over the cutting spindles 9, there are provided a pair (right and left) of horizontal frames 5 extending in the direction orthogonally intersecting with the direction of the axial center line of the cutting spindles 9, i.e. orthogonally intersecting with a virtual line passing through the rotational centers P of each cross-section orthogonally intersecting with the longitudinal direction of the cutting spindles 9. The pair of horizontal frames 5 have at least a sufficient length to extend from the cutting spindles 9 to the centering position of log to be explained below and are extended in the direction of X or in the horizontal direction.

On this horizontal frames 5, there is also supported a movable frame 11 extending in the direction of Z or in parallel with the axial center line P of the cutting spindles 9. More specifically, the movable frame 11 is supported through the opposite end portions thereof on the horizontal frames 5 and is permitted to move in the direction of X orthogonally intersecting with the axial center line P of the cutting spindles 9. Namely, a screw 15*a* is attached respectively to the opposite end portions of the movable frame 11 and engaged with moving members 15 (such as a feed screw) having an axial center line extending in the direction of X orthogonally intersecting with the axial center line P of the cutting spindles 9 and being axially supported by the frame 3. This moving members 15 are coupled with an electric motor 13 which is mounted on the horizontal frame 5. Accordingly, the movable frame 11 is enabled to reciprocatively move within a region between the log feeding position located over the cutting spindles 9 and the log centering position located over the centering spindles 29 to be explained hereinafter.

By the way, the electric motor 13 is provided with a rotational angle detector 13*a* such as a rotary encoder, thereby making it possible to numerically control the magnitude of movement of the movable frame 11 in conformity with the magnitude of rotation of the electric motor 13.

A pair of holders 17 facing to each other are movably supported by the movable frame 11, thus permitting the holders 17 to move in the direction of Z or along the longitudinal direction of the movable frame 11. Each holder 17 is coupled with a first operating member 19 such as a hydraulic cylinder which is attached to a mounting plate 11*a* suspended from an intermediate portion of the movable frame 11. As a result, these holders 17 are enabled, through the operation of each first operating member 19, to move in the direction of Z to come close to each other or go away from each other.

Although each holder 17 is shown in FIG. 2 as being perpendicularly suspended, each holder 17 may be inclined toward the cutting spindles 9 or toward the centering spindles 29.

Each holder 17 is provided, on the surface thereof facing the other holder 17, with a holding member 21, which is permitted to move in the vertical direction or in the direction of Y as shown in FIG. 2. Namely, each holding member 21 is coupled with a vertically movable member 25 such as a feed screw which is connected with an electric motor 23 fixed to the holder 17, thus enabling each holding member 21 to vertically move along the direction of Y by means of the vertically movable member 25 to be driven by the electric motor 23.

Figure 4:
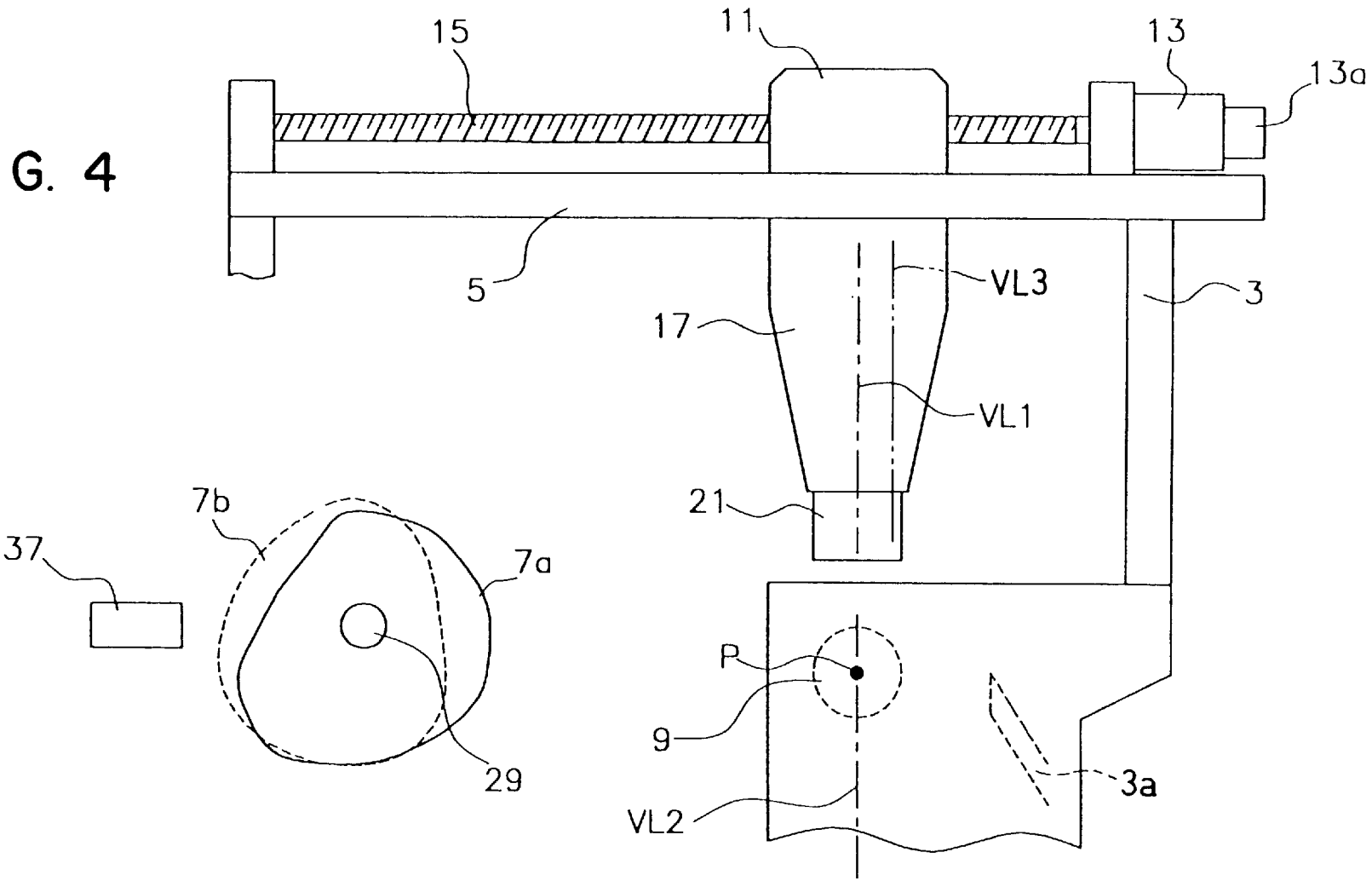
FIG. 4 is an enlarged front view illustrating a centering and feeding mechanism.
Figure 5:
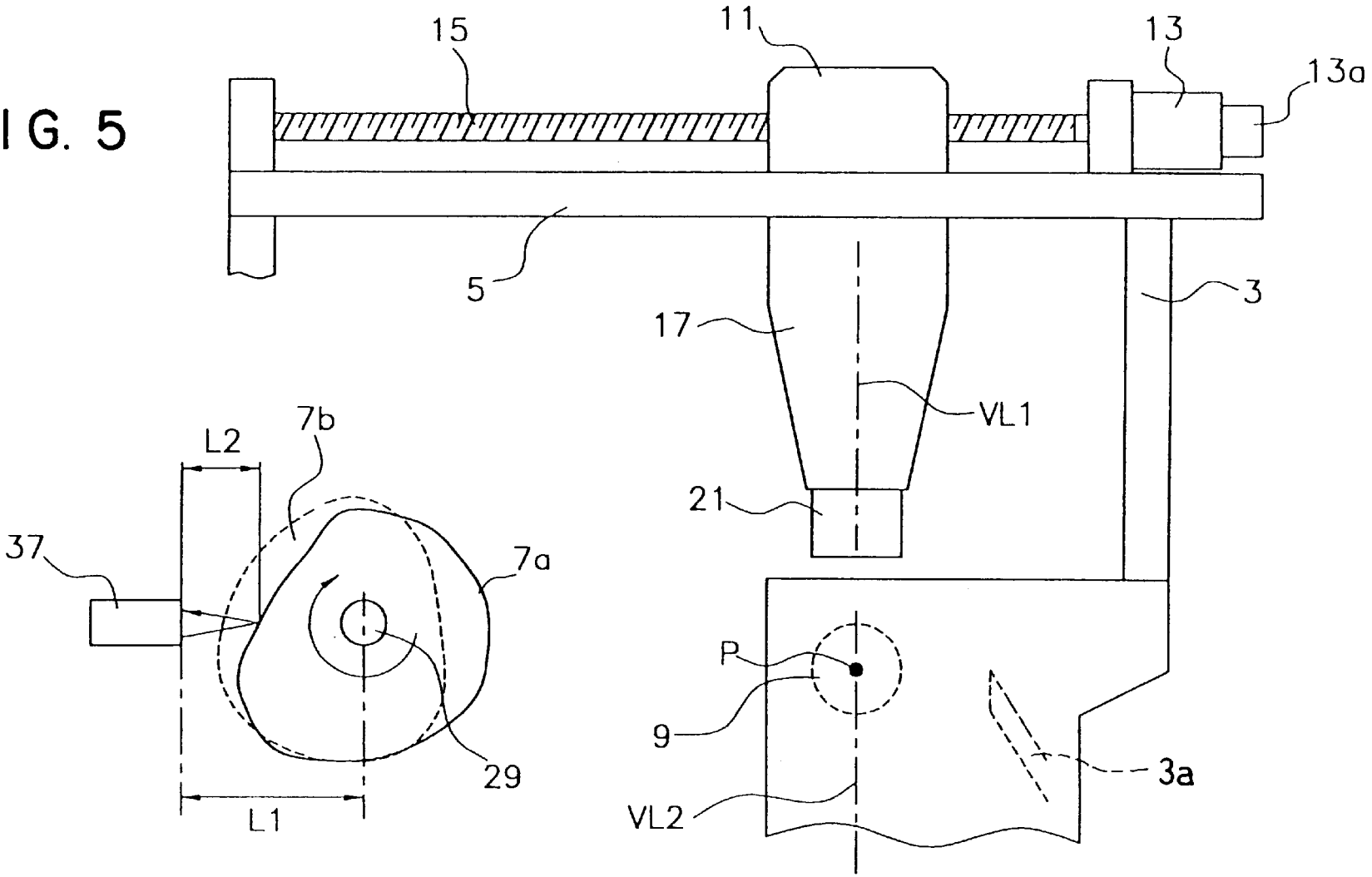
FIG. 5 is an enlarged front view illustrating a centering and feeding mechanism.
Figure 6:
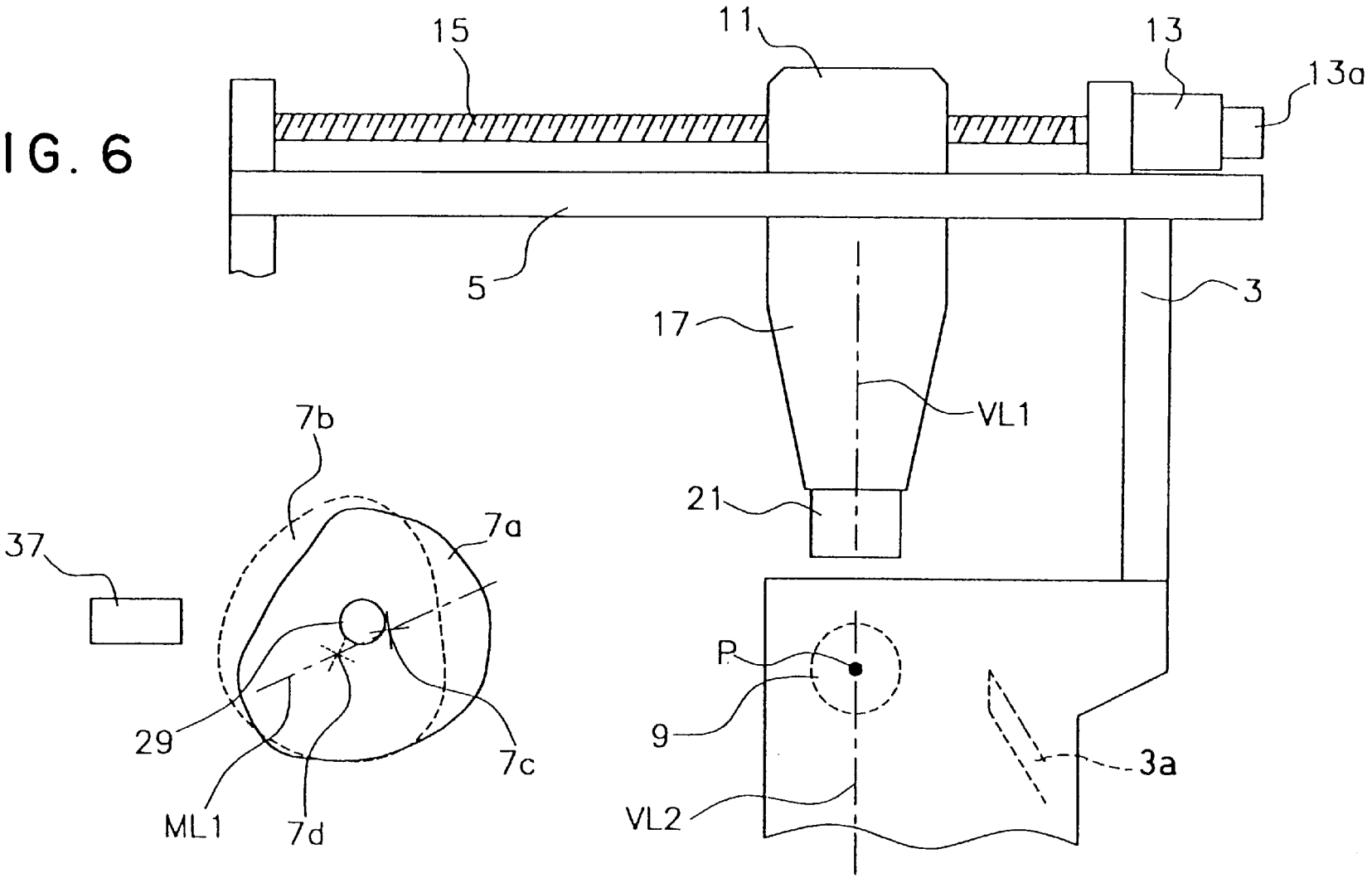
FIG. 6 is an enlarged front view illustrating a centering and feeding mechanism.

By the way, a virtual line VL1 functioning as a reference (base) line for moving the holding members 21 to a predetermined position is set in advance to the holding members 21 in such a manner that the line is parallel with the vertical moving direction of the holding members 21 in relative to the holders 17 and passes through a given point that has been fixedly set in relative to the holding members 21, for example a central in the lateral direction of the holding members 21 in FIG. 4 in this -embodiment. Therefore, if it is desired to move the holding members 21 through a movement of the movable frame 11, the movement of the holding members 21 is controlled such that, on the basis of information from the rotational angle detector 13*a*, the position of the virtual line VL1 of the holding members 21 is positioned at a desired point.

By the way, each holding member 21 is provided at a lower portion of the facing surface with a claw 21*a* to be pierced into the end face of log so as to hold the log 7. Further, the electric motor 23 is provided with a rotational angle detector 23*a* such as a rotary encoder, thereby making it possible to numerically control the magnitude of the vertical movement of the holding members 21 in conformity with the magnitude of rotation of the electric motor 23.

A pair of centering spindles 29, facing to each other, are mounted on a portion of the frame 3 which is located away from the axial center line of the cutting spindle 9 by a predetermined distance toward the centering position, these centering spindles 29 having an axial center line parallel with the axial center line of the cutting spindle 9, and being rotatable and movable in the direction of the axial center line thereof or in the direction of Z. Specifically, spline grooves 29*b* having a predetermined width are formed on the outer circumferential wall of an intermediate portion of the centering spindle 29 positioned on the left side of FIG. 2, and the centering spindle 29 is coupled with a rotational body 33 which is connected with an electric motor 31 attached to the frame 3. Since the rotational body 3 is engaged with the spline grooves 29*b*, the centering spindle 29 is prevented from being rotated about the axial center line thereof, but is permitted to slide in the direction of the axial center line or in the direction of Z. Accordingly, the centering spindle 29 is allowed to rotate only through the driving force of the electric motor 31. On the other hand, a second operating member 35 such as a hydraulic cylinder is rotatably mounted on the external end portion of the centering spindle 29, thereby enabling the centering spindle 29 to move in the direction of the axial center line or in the direction of Z through an actuation of this second operating member 35 so as to chuck the both end faces 7*a* and 7*b* of the log 7.

In the embodiment shown FIG. 2, only one out of the pair of centering spindles 29 is coupled with the electric motor 31, while allowing the other centering spindle 29 to be acted as a follower. However, it is also possible to adopt a structure where both centering spindles 29 are coupled with the electric motor 31. The electric motor 31 is provided with a rotational angle detector 31*a* such as a rotary encoder for detecting a turning angle of the centering spindle 29.

On the left side of the frame 3 shown in FIG. 2, there are disposed for instance three log center detectors 37, which are positioned at a level which is almost identical with the height of the centering spindles 29 and are spaced apart from the centering spindle 29 by a predetermined distance L1. In this embodiment, these three log center detectors 37 are disposed to face the outer circumferential surfaces of both end portions and an intermediate portion (all in relative to the direction of Z) of the log 7 being chucked by the centering spindle 29. Each log center detector 37 is provided with a light source for irradiating a light toward each outer circumferential surface of the log, and a light-receiving member for receiving a light reflected from each outer circumferential surface of the log 7 (these components are not shown). This log center detector 37 is designed to measure the maximum and minimum diameters of the log 7 from the center of the centering spindle 29 at each location on the basis of a distance L2 between each outer circumferential surface of the log 7 and the log center detector 37 that can be calculated based on the distance L1 between the axial center line of the centering spindle 29 which has been set in advance and the log center detector 37, and on the time interval required for the light starting from the irradiation thereof from each log center detector 37 and finishing upon receipt of the light reflected from each outer circumferential surface of the log 7. The control means to be discussed hereinafter determines, through processing of data measured in this manner, the positions of axial center 7*c* and 7*d*, thus estimating the positions of axial center at the opposite end faces of the log 7.

Figure 3:
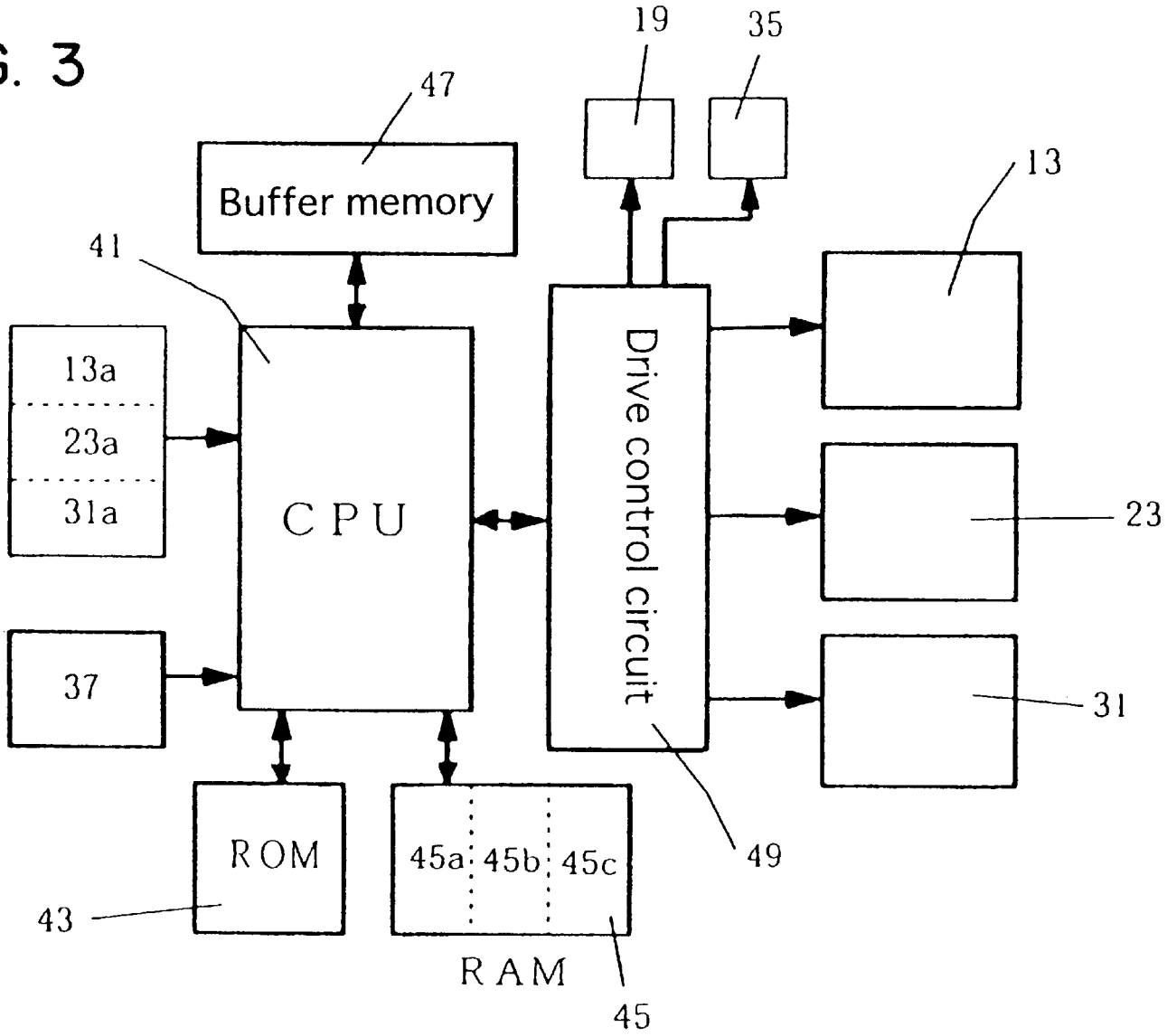
FIG. 3 is a block diagram illustrating the controlling means of a log centering apparatus.

FIG. 3 shows an electric block diagram illustrating the controlling means of the log centering and feeding apparatus.

The program data for performing the centering of the log 7 and the feeding of the log 7 to the cutting spindle 9 are stored in the ROM 43 of the CPU 41 constituting the control means. The RAM 45 of the CPU 41 is provided with a first to third memory regions 45*a* to 45*c*, wherein the first memory region 45*a* is designed to store the positional data on the rotational center P of the cutting spindle 9, and on the positions of the centering spindle 29 and the log axial center detector 37; the second memory region 45*b* is designed to store the distance data L2 between each log axial center detector 37 and the outer circumferential surface of the log 7 at each turning angle of the centering spindle 29; and the third memory region 45*c* is designed to store the data on the positions of axial center which are assumed to constitute the axial centers at both end faces 7*a* and 7*b* of the log 7 that can be calculated from the data stored in the first memory region 45*a* and the second memory region 45*b*. By the way, the reference numeral 47 represents a buffer memory designed to temporarily store the control data that have been processed based on the data stored in the first to third memory regions 45*a* to 45*c*.

The CPU 41 is connected with a drive control circuit 49, which is designed to control the operation of electric motors 13, 23 and 31 on the basis of control data stored in the buffer memory 47, or to control the operation of the moving member 15 or of the first and second operating members 19 and 35. Next, the operation of centering and feeding a log will be explained. FIGS. 4 to 10 illustrate the operation of centering and feeding a log.

The movable frame 11 is moved in advance to the cutting spindle 9 and kept in a state of stand-by so as not to interfere with the log 7 to be centered. Under this condition, the log 7 is fed to a space between a pair of the centering spindles 29 after the log 7 is temporarily centered by means of V-shaped frames (not shown) which are descendibly disposed at the centering section of the veneer lathe and near opposite end faces 7*a*, 7*b* and an intermediate portion of the log 7 (alternatively, the log 7 is fed to a space between a pair of the centering spindles 29 by means of a known log charger (not shown)). Thereafter, the second operating member 35 is actuated based on a signal from the CPU 41, thereby causing the centering spindles 29 to move toward each other so as to chuck the opposite end faces 7*a*, 7*b* of the log 7 (see FIG. 4, the centering spindles 29 are not shown in FIG. 4).

Then, the electric motor 31 is actuated based on a signal (hereinafter referred to as signal from the CPU 41) from the drive control circuit 49 actuated based on a signal from the CPU 41, thereby rotating the centering spindles 29 and hence to cause the log 7 to be rotated at least one revolution, during which the distance L2 between each outer circumferential surface (the portions of the opposite end faces 7*a*, 7*b* and intermediate portion) of the log 7 and the log center detector 37 is measured, thus detecting the positions of axial centers 7*c* and 7*d* of the opposite end faces 7*a* and 7*b* of the log 7.

Namely, the distance between the axial center line of the centering spindles 29 and the log center detector 37 is set in advance to a predetermined distance L1. Under this condition, the distance L2 between each outer circumferential surface (the portions of the opposite end faces 7*a*, 7*b* and intermediate portion) of the log 7 and the log center detector 37 at each turning angle of the centering spindles 29 is measured by making use of the log center detector 37 while the log 7 is allowed to rotate. The data on the maximum and minimum outer diameters of each portion of the log 7 as measured from the center of the centering spindles 29, which have been obtained in this manner are stored in the second memory region 45*b*. As the log 7 is turned at least one revolution, the positions of axial centers 7*c* and 7*d* of the log is calculated based on the data concerning the turning angle and the maximum and minimum outer diameters at each portion of the log that have been stored in the second memory region 45*b* according to the signals from the CPU 41, the resultant data on the positions of axial centers 7*c* and 7*d* of the log are stored in the third memory region 45*c* (see FIGS. 5 and 6, wherein the solid line denotes the front end face 7*a* and the prospective position of axial center 7*c* at the front end face 7*a*; while the broken line denotes the rear end face 7*b* and the prospective position of axial center 7*d* at the rear end face 7*b*).

Figure 7:
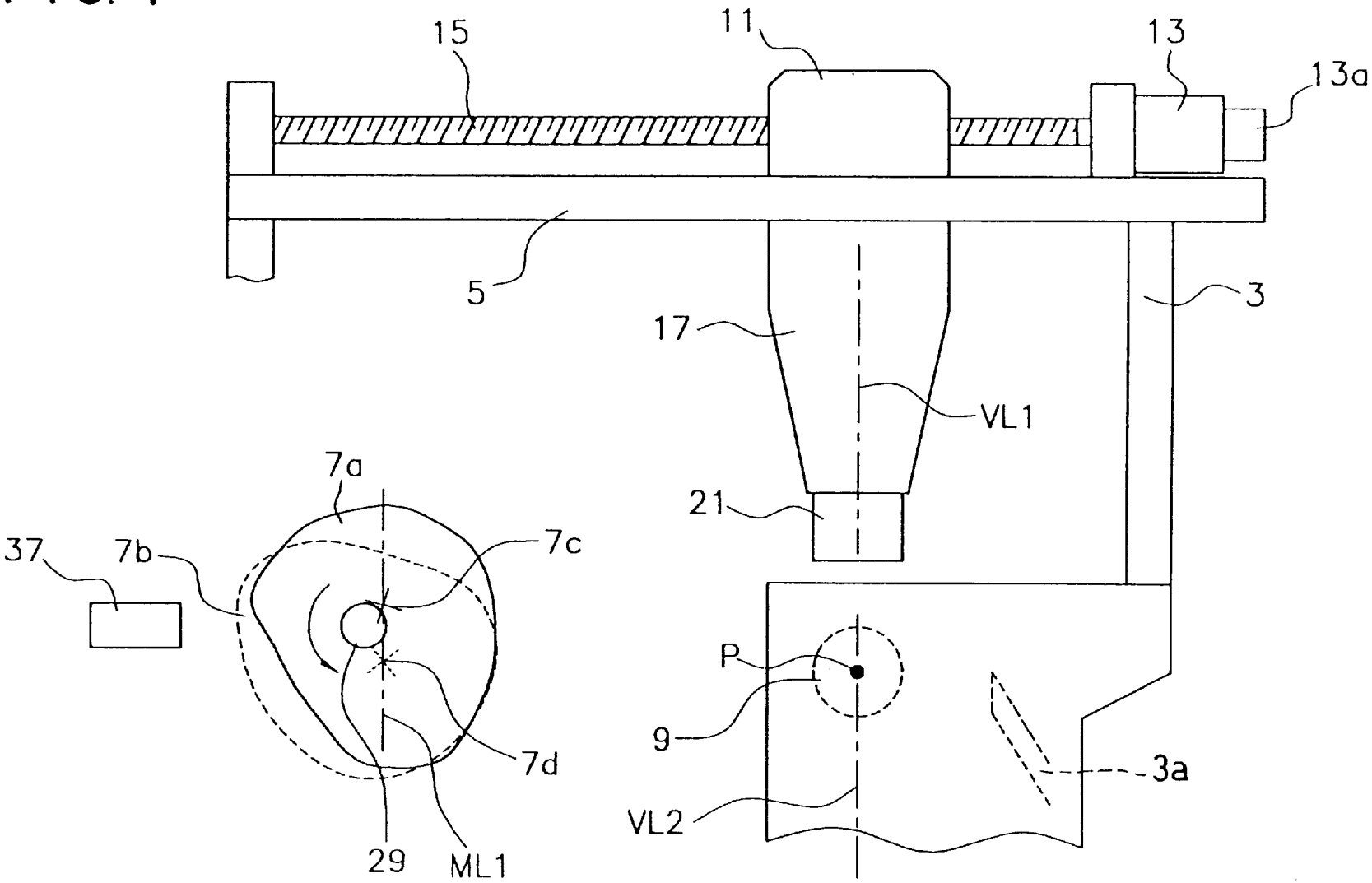
FIG. 7 is an enlarged front view illustrating a centering and feeding mechanism.
Figure 8:
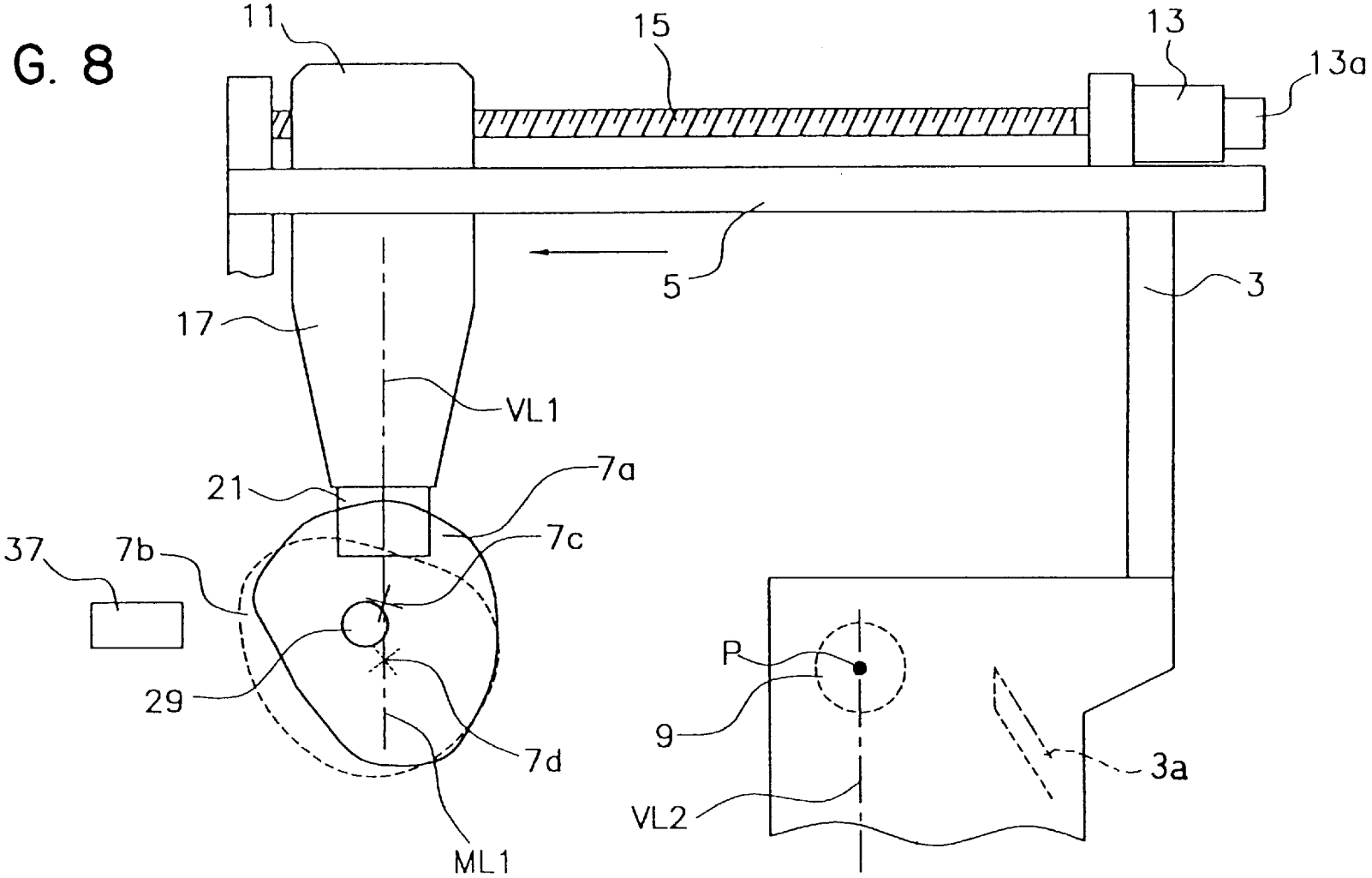
FIG. 8 is an enlarged front view illustrating a centering and feeding mechanism.

Then, according to the signals from the CPU 41, the electric motor 31 is actuated to further rotate the log 7 on the basis of the data of the prospective positions of axial centers 7*c* and 7*d* at the opposite end faces 7*a* and 7*b* of log that have been stored in the third memory region 45*c*, thereby rendering the virtual line ML1 passing through the prospective axial centers 7*c* and 7*d* at the opposite end faces 7*a* and 7*b* of log 7 to agree or align (as viewed from the Z direction which is parallel with the axial center line of the centering spindle 29) with the vertical line, i.e. the moving direction of the holding members 21 in relative to the holders 17 (see FIG. 7). Concurrently, the distance from the center P of the spindle 9 to the virtual line ML1 is calculated by the CPU 41 to obtain data, the signal of which is then utilized to drive the electric motor 13 and hence, to obtain the information on the positions by making use of the rotational angle detector 13*a*. On the basis of the information on the positions, the movable frame 11 is moved from the cutting spindle 9 side so as to render the vertical line VL1 that has been preset in the holding member 21 to align with the aforementioned virtual line ML1 (see FIG. 8).

In the above embodiment, the log 7 is further rotated based on the data of the positions of axial center so as to render the virtual line ML1 passing through every axial centers at various portions of the log to agree or align with the vertical line, after which the holding members 21 are moved toward the centering region of the apparatus so as to render the virtual line ML1 to align with the vertical line VL1 passing through the center of the holding members 21. Alternatively, it may be controlled such that the virtual line ML1 is orientated to the vertical direction during the holding members 21 are being moved toward the centering region after the data on the axial centers are calculated by the CPU 41, or after the holding members 21 are moved to the region of the centering spindle 29.

Next, the first operating member 19 is actuated based on a signal from the CPU 41 so as to move the holders 17 toward each other thereby causing the holding members 21 to press-contact with and hold the opposite end faces 7*a* and 7*b* of the log 7 that has been chucked by the centering spindles 29. Thereafter, the second operating member 35 is allowed to return, and the centering spindles 29 are also moved away from each other, whereby the log 7 is released from the chucking by the centering spindles 29.

Figure 9:
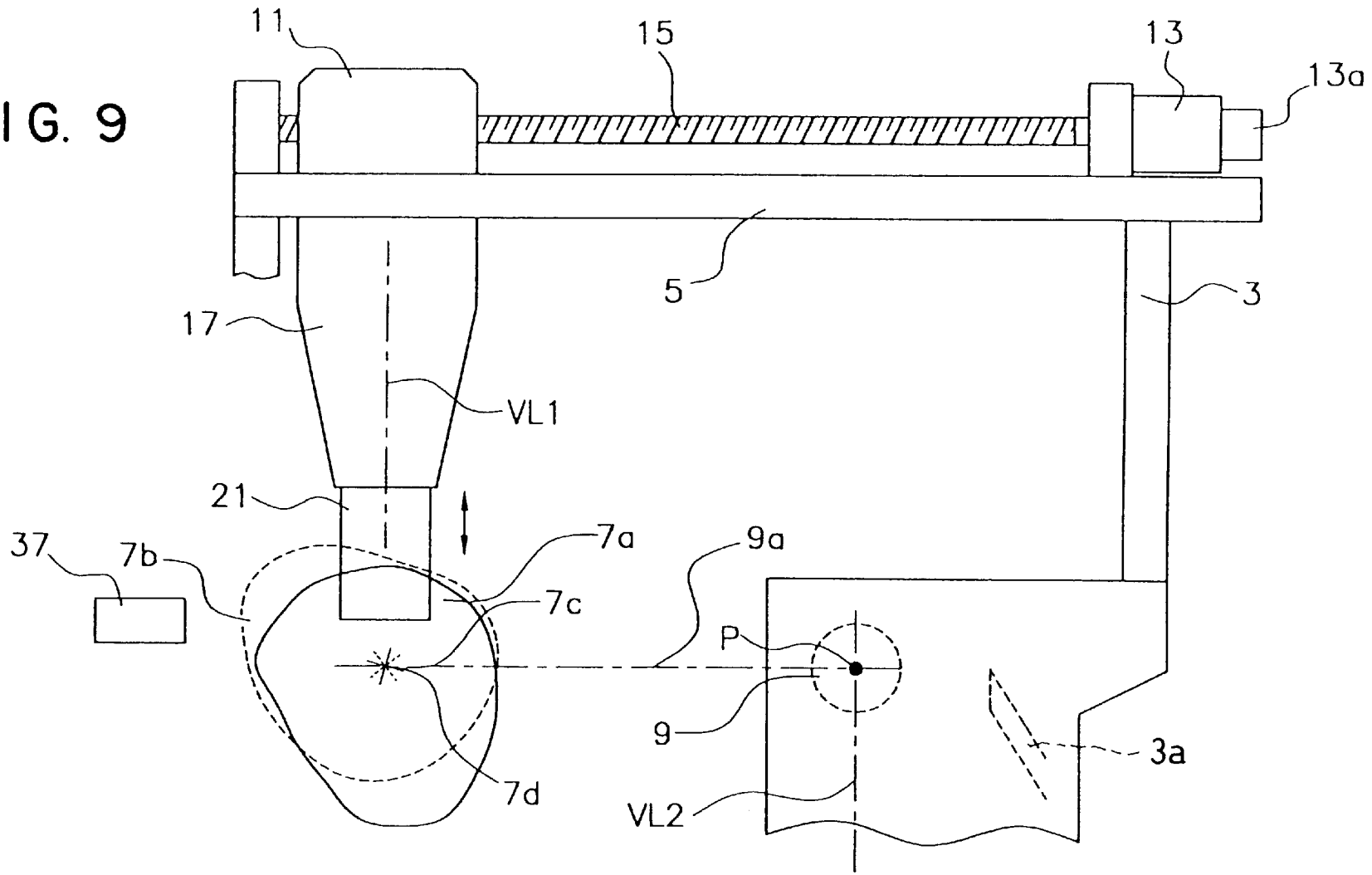
FIG. 9 is an enlarged front view illustrating a centering and feeding mechanism.
Figure 10:
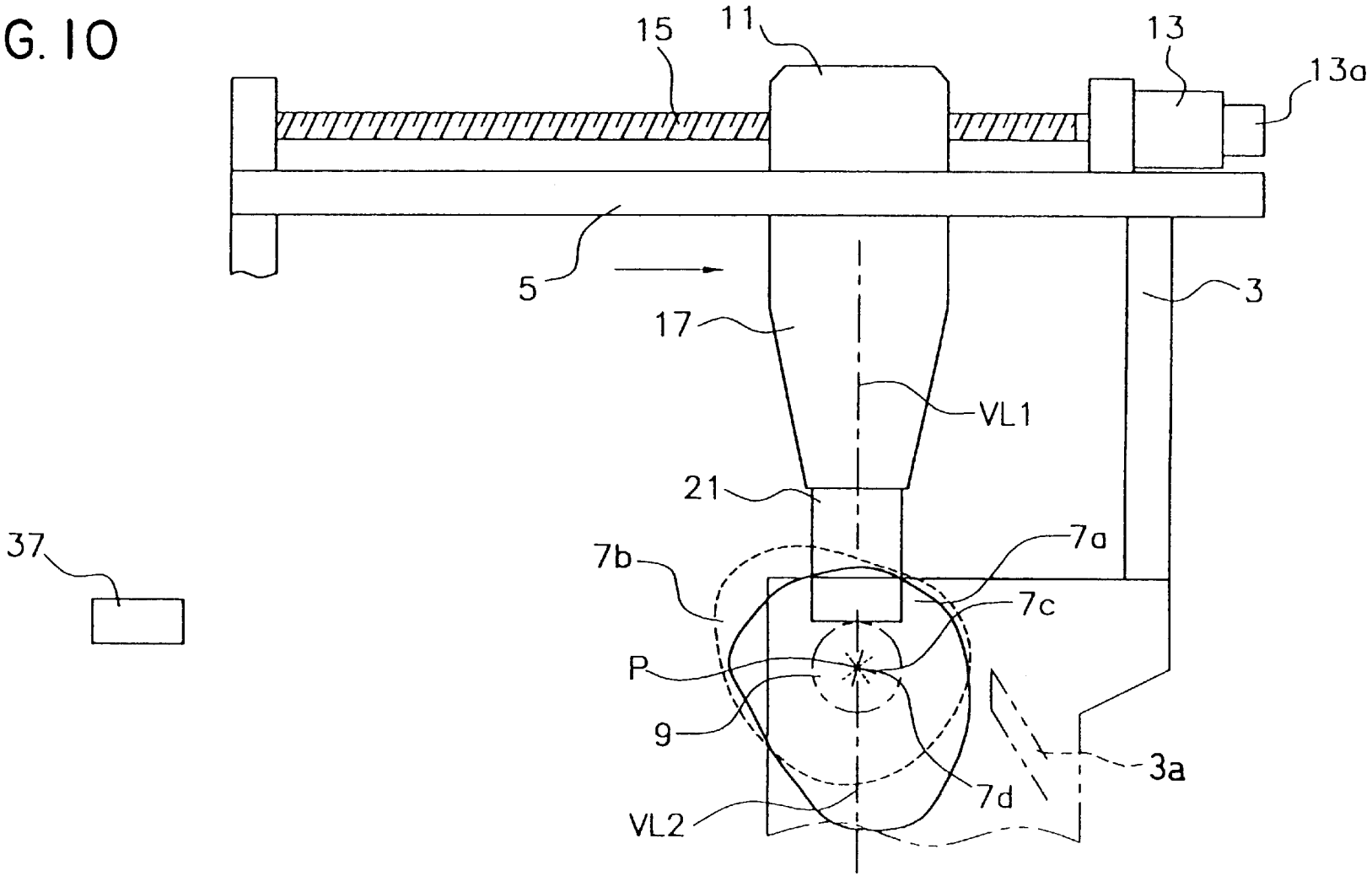
FIG. 10 is an enlarged front view illustrating a centering and feeding mechanism.

Thereafter, upon receipt of a signal from the CPU 41, each electric motor 23 is independently actuated based on the data of the prospective axial centers 7*c* and 7*d* at the opposite end faces of the log 7 and on the positional data of the rotational center P of the cutting spindle 9, thereby rendering each of the holding members 21 to move in the vertical direction so as to align the prospective axial centers 7*c* and 7*d* of the opposite end faces of the log 7 with the height of the rotational center P of the cutting spindle 9 (see FIG. 9).

By the way, this operation of aligning the prospective axial centers 7*c* and 7*d* of the opposite end faces of the log 7 chucked by means of the holding members 21 with the rotational center P of the cutting spindle 9 may be performed as mentioned later during the holding members 21 are being moved toward the cutting spindle 9, or after holding members 21 have been moved to the cutting spindle side.

Then, based on a signal from the CPU 41, the electric motor 13 is driven to move the movable frame 11 holding the log 7 by means of holding members 21 to such an extent that the prospective axial centers 7*c* and 7*d* of the opposite end faces of the log 7 reach the vertical line VL2 passing through the rotational center P of the spindle 9. Thereafter, a spindle-operating member (not shown) is actuated causing the cutting spindles 9 to move toward each other so as to chuck the opposite end faces 7*a*, 7*b* of the log 7 in alignment with the axial centers 7*c* and 7*d* (see FIG. 10).

After the log 7 is chucked by making use of the cutting spindles 9, a signal is transmitted from the CPU 41 to the first operating member 19 thereby to move the first operating member 19 to return, and hence, the holding of the log 7 by means of the holding members 21 is released, after which the electric motor 23 is actuated to move each holding member 21 back to the original position, thus finishing the centering and feeding operation of the log 7.

In the above embodiment 1, the virtual line VL1 to be set in the holding members 21 as a reference line for moving the holding members 21 to a predetermined position is selected as passing through a predetermined position in relative to the holding members, i.e. the central point in the lateral direction of the holding members 21 as shown in FIG. 4. Therefore, the virtual line VL1 is selected to be the one which passes through the aforementioned central point and is parallel with the vertical moving direction of the holding members 21 in relative to the holders 17. However, there is not any particular limitation regarding this point as long as this point is located at any definite position in relative to the holding members 21. Therefore, if there is no problem in holding the log 7 by means of the holding members 21, this point may be set at a point located outside the holding members 21.

For example, a virtual line may be selected in such a way that the virtual line passes through a point other than the aforementioned central point and is made parallel with the vertical moving direction of the holding members 21, thereby setting a virtual line VL3 in the holding members 21 as shown in FIG. 4, which is displaced right-ward from the virtual line VL1. At the occasion of moving the holders 17, the holders 17 are moved based on a signal from the CPU 41 so as to make the virtual line VL3 align with the virtual line ML1 as illustrated in FIG. 7, thereby allowing the log 7 to be held by the holding members 21. Thereafter, the holders 17 are further moved until the virtual line VL3 is aligned with the virtual line VL2. During or after this movement of the holder 17, each of the holding members 21 is moved in the vertical direction so as to align the prospective axial centers 7*c* and 7*d* of the opposite end faces of the log 7 with the height of the center P of the cutting spindle 9, after which the log 7 is allowed to be chucked by making use of the cutting spindle 9.

Embodiment 2

According to Embodiment 1, the holder 17 is linearly and reciprocatively moved between the position where the reference virtual line VL1 of the holding members 21 passes through the rotational center P of the cutting spindle 9 and a desired position on the centering spindle (29) side. However, according to Embodiment 2, the holder 17 is linearly and reciprocatively moved between a desired position on the cutting spindle (9) side and the position where the reference virtual line of the holding members 21 on the centering spindle (29) side passes through a point which is located away by a predetermined distance from the rotational center P of the cutting spindle 9.

Namely, although Embodiment 2 is the same in construction of every members with Embodiment 1, the reference virtual line to be set in the holder 17 and the manner of controlling by means of the CPU functioning as control means are altered from Embodiment 1 as explained below.

In the same manner as explained in Embodiment 1, based on a signal from the CPU 41, the log 7 is caused to rotate at least one revolution by making use of the centering spindles 29, thus detecting the prospective positions of axial centers 7*c* and 7*d* of the opposite end faces 7*a* and 7*b* of the log 7.

Then, the log 7 is further rotated so as to render the virtual line ML1 passing through the prospective axial centers 7*c* and 7*d* of the opposite end faces 7*a* and 7*b* of log 7 to agree or align (as viewed from the Z direction) with the vertical direction.

Figure 11:
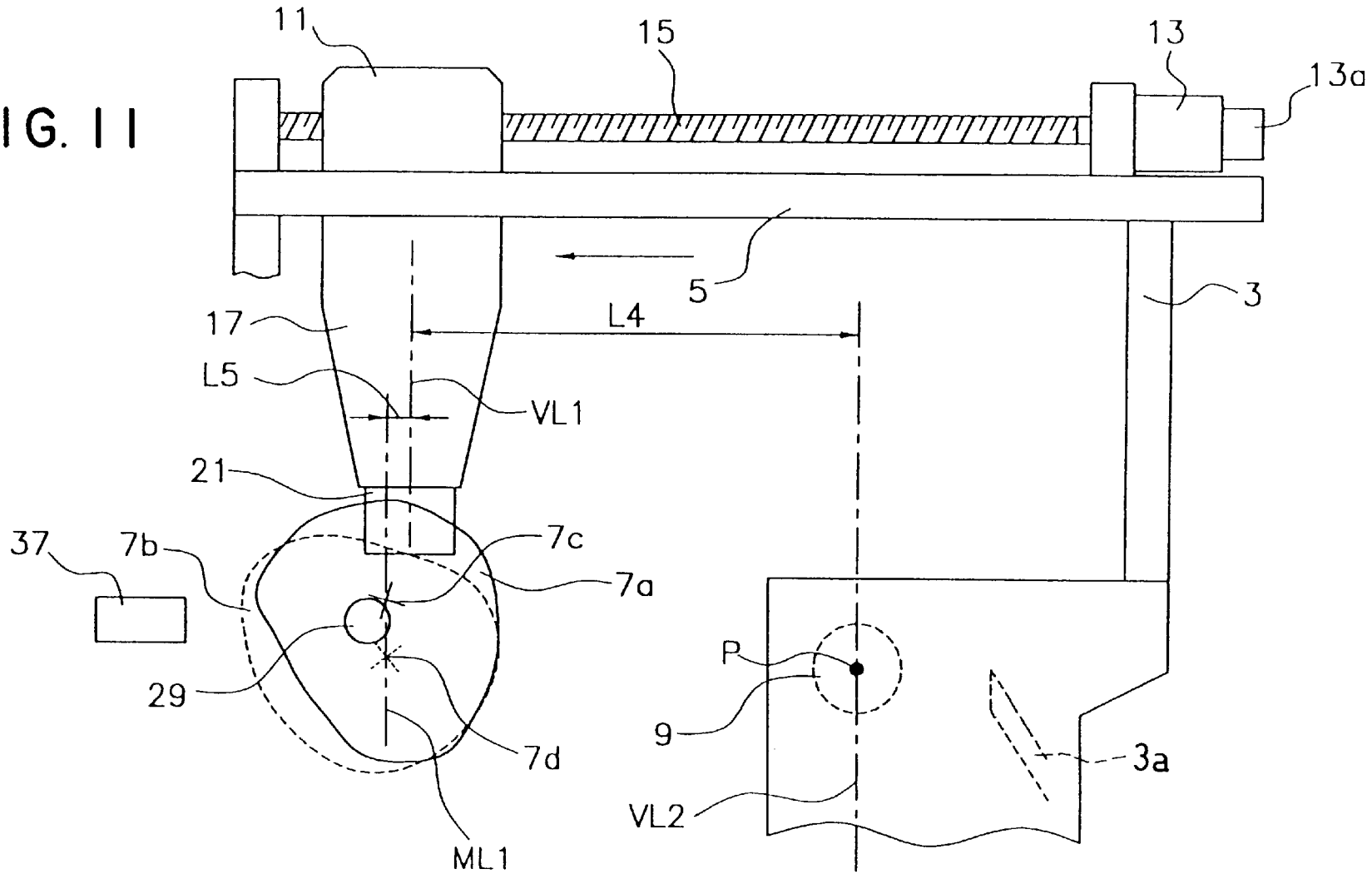
FIG. 11 is a front view schematically showing a log centering apparatus including a veneer lathe according to a second embodiment of the present invention.

On the other hand, at the occasion of moving the holders 17 toward the centering spindle 29 through the movement of the movable frame 11 on the basis of a signal from the CPU 41, the reference virtual line VL1 of the holder 17 is always positioned at a predetermined location which is displaced by a predetermined distance L4 from the rotational center P of the cutting spindle 9 toward the centering spindle 29 as shown in FIG. 11, and is kept in a state of stand-by.

After the virtual line ML1 has been aligned with the vertical direction and the holder 17 has been kept in a state of stand-by at a predetermined position, the distance L5 between the reference virtual line VL1 that has been preset in the holder 17 and the virtual line ML1 is calculated by means of the CPU 41, and the holding member 21 is moved in the Z direction so as to hold the opposite end faces 7*a* and 7*b* of the log 7, after which the chucking of the log 7 by means of the centering spindles 29 is released.

Thereafter, based on a signal from the CPU 41, the movable frame 11 is moved toward the cutting spindle 9 to such an extent that the reference virtual line VL1 of the holder 17 is positioned at a place which is displaced by a distance of L5 toward the right side of the vertical line VL2 passing through the rotational center P of the cutting spindle 9 as shown in FIG. 11. When the movable frame 11 is moved up to this place, the movement of the movable frame 11 is stopped.

In the same manner as in Embodiment 1, during or after the movement of this movable frame 11, each electric motor 23 is independently actuated based on the data of the prospective axial centers 7*c* and 7*d* at the opposite end faces of the log 7 and on the positional data of the rotational center P of the cutting spindle 9, thereby rendering each of the holding members 21 to move in the vertical direction so as to align the prospective axial centers 7*c* and 7*d* of the opposite end faces of the log 7 with the height of the rotational center P of the cutting spindle 9.

After finishing these operations, a spindle-operating member (not shown) is actuated causing the cutting spindles 9 to move toward each other so as to chuck the opposite end faces 7*a*, 7*b* of the log 7 in alignment with the axial centers 7*c* and 7*d*.

Embodiment 3

Figure 12:
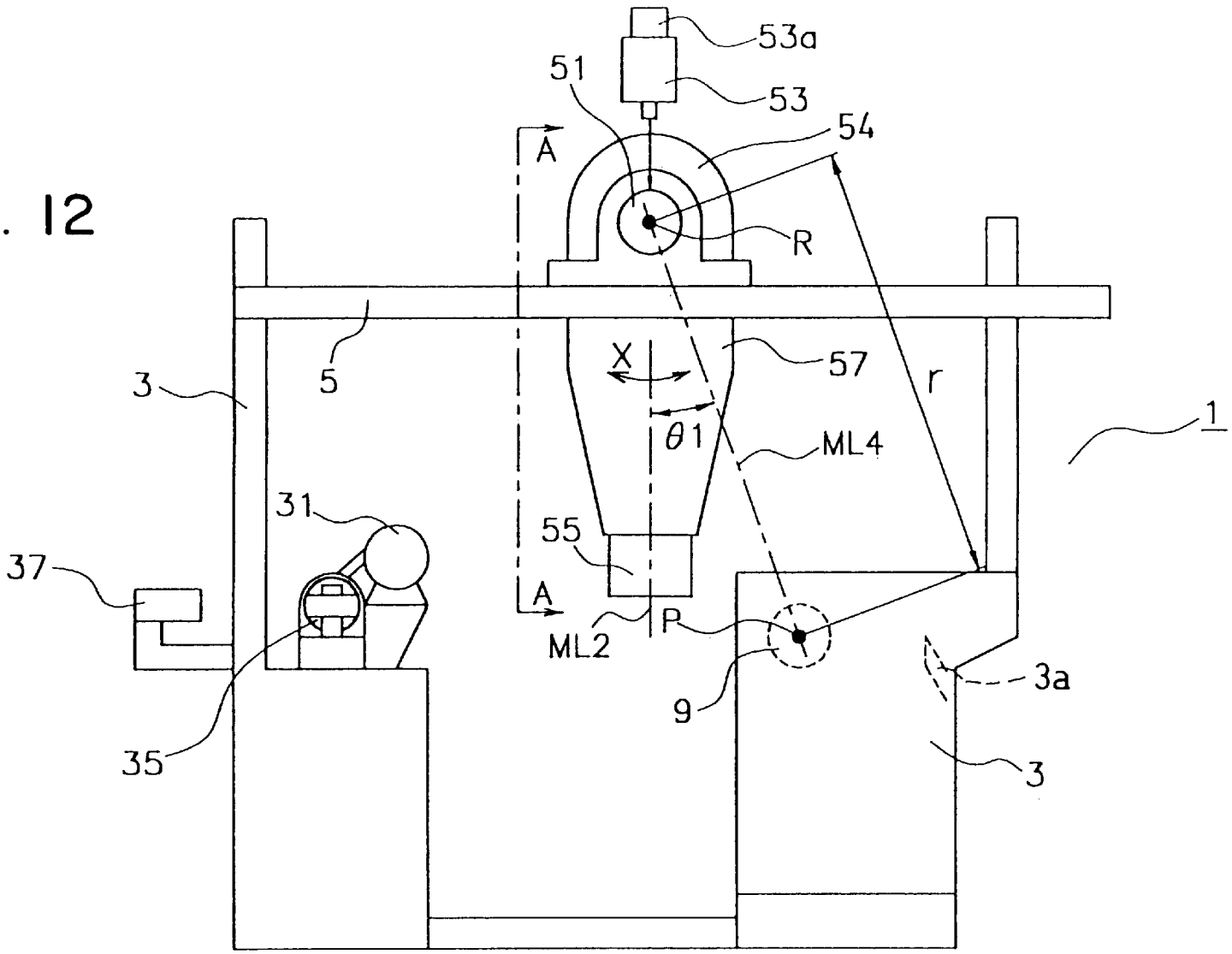
FIG. 12 is a front view schematically showing a log centering apparatus including a veneer lathe according to a third embodiment of the present invention.
Figure 13:
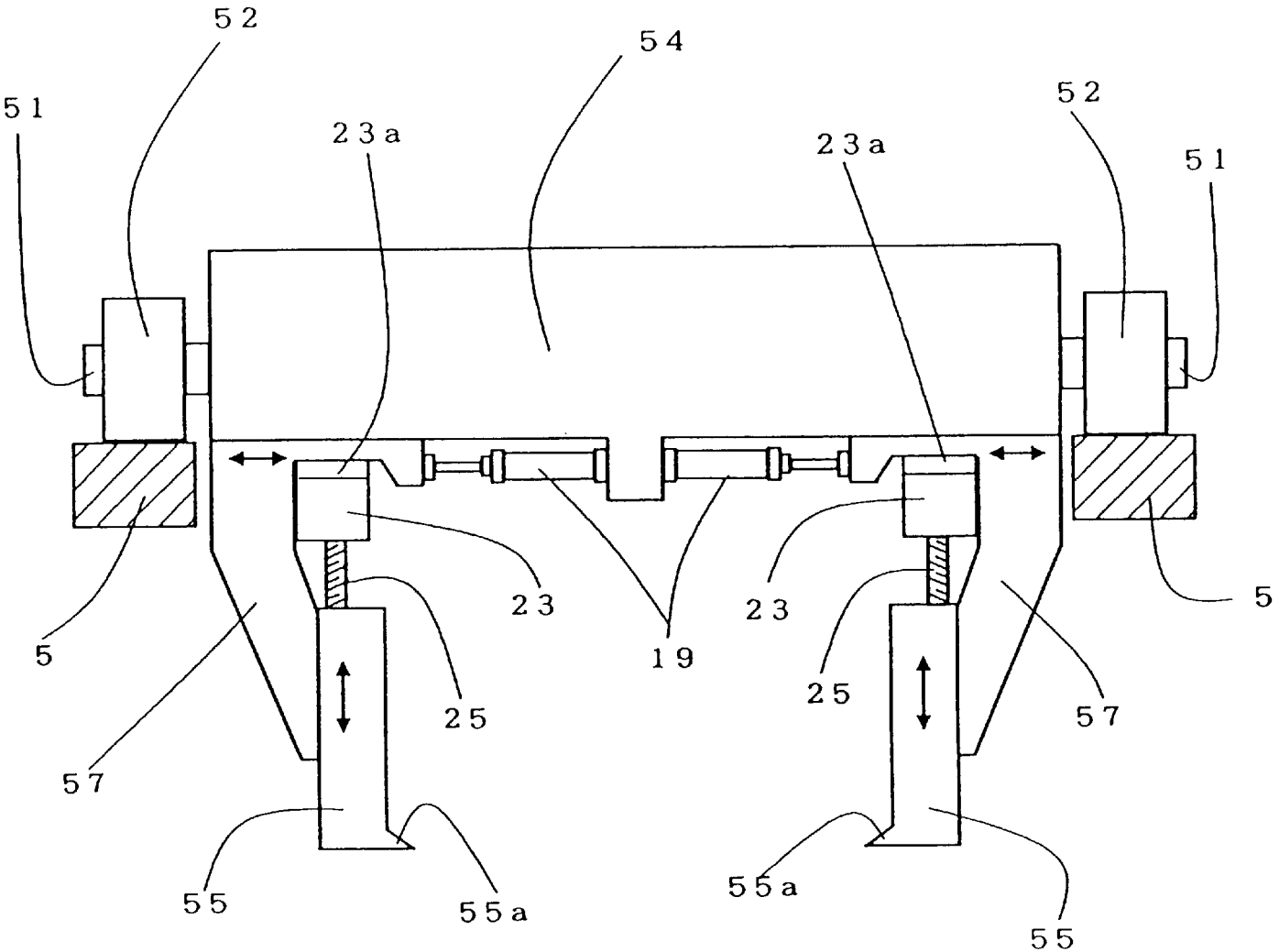
FIG. 13 is an enlarged side view taken along a dot and dash line A—A of FIG. 12 and viewed from the direction of arrow.

FIG. 12 shows a front view schematically illustrating a log centering apparatus according to a third embodiment of the present invention, while FIG. 13 shows an enlarged side view taken along a dot and dash line A—A of FIG. 12 and viewed from the direction of arrow.

Referring to these FIGS. , horizontal frames 5 is positioned extending over the cutting spindle 9 and over the second operating member 35, and a shaft 51 coupled with an electric motor 53 is rotatably and axially supported on this horizontal frame 5. A rotatable frame 54 is fixed to this shaft 51.

This electric motor 53 is provided with a rotational angle detector 53*a* such as a rotary encoder, thereby making it possible to numerically control the rotation of the shaft 51 on the basis of detected signals from the rotational angle detector 53*a* as explained below.

As shown in FIG. 13, a pair of holders 57 facing to each other and spaced apart from each other are supported by the rotatable frame 54 in such a manner that the holders 57 are prevented from being rotated about the axial center line thereof but is permitted to move in the direction of the axial center line (longitudinal direction) of the shaft 51. Each holder 57 is coupled with a first operating member 19 such as a hydraulic cylinder which is attached to the rotatable frame 54. As a result, these holders 57 are enabled, through the operation of corresponding first operating member 19, to move in the direction of Z to come close to each other or go away from each other.

A holding member 55 having a claw 55*a* is movably supported by each holder 57 in the same manner as illustrated in Embodiment 1, so that the holding member 55 is enabled to move vertically in relative to the holder 57. Namely, each holding member 55 is coupled with a vertically movable member 25 such as a feed screw which is connected with an electric motor 23 fixed to the holder 57, thus enabling each holding member 55 to vertically move along the direction of Y by means of the vertically movable member 25 to be driven by the electric motor 23.

By the way, a line functioning as a reference for rotating the holding members 55, i.e. a virtual line ML2 passing through a central point in the lateral direction of the holding member 55 and extending in the radial direction of the shaft 51 as shown in FIG. 12 of the present invention is preset. Therefore, if it is desired to rotate the holding members 55 through a rotation of the rotatable frame 54 in the direction of X, the rotation of the holding members 55 is controlled such that, on the basis of information from the rotational angle detector 53*a*, the position of the virtual line ML2 of the holding members 55 is positioned at a desired point as described below.

By the way, the electric motor 23 is provided with a rotational angle detector 23*a* such as a rotary encoder, thereby making it possible to numerically control the magnitude of the movement of the holding members 55 in accordance with the detected signals from the rotational angle detector 23*a*. Since other structure of this embodiment is the same as that of Embodiment 1, the same reference numerals are employed for the same parts thereby to omit the explanation thereof.

A pair of centering spindles 29, facing to each other, are mounted on a portion of the frame 3 which is located away from the axial center line of the cutting spindle 9 by a predetermined distance toward the centering position, these centering spindles 29 having an axial center line parallel with the axial center line of the cutting spindle 9, and being rotatable and movable in the direction of the axial center line thereof or in the direction of Z. Specifically, spline grooves 29*b* having a predetermined width are formed on the outer circumferential wall of an intermediate portion of the centering spindle 29 positioned on the left side of FIG. 2, and the centering spindle 29 is coupled with a rotational body 33 which is connected with an electric motor 31 attached to the frame Next, the operation of centering and feeding a log according to this embodiment will be explained.

FIGS. 14 to 17 illustrate the operation of centering and feeding a log.

The holders 57 and holding members 55 are rotated in advance by means of the shaft 51 so as to be placed to take a position, for example, a position where the virtual line ML2 in the holding members 55 is orientated in the vertical direction, which does not interfere with the log 7 to be centered, and are left in a state of stand-by (see FIG. 12). By the way, the holders 57 and holding members 55 may be kept in a stand-by state by orienting the virtual line ML2 to a direction inclined toward the cutting spindle 9.

By the way, the value of distance "r" between the center R of the shaft 51 and the center P of the cutting spindle 9, as well as the value of angle θ1 between the virtual line ML4 passing through the centers R and P and the virtual line ML2 are input, in advance, in the CPU 41.

Then, in the same manner as explained in Embodiment 1, the log 7 is fed to a space between a pair of centering spindles 29 by means of V-shaped frames (not shown) or a log charger (not shown), and then, based on a signal from the CPU 41 under this condition, the centering spindles 29 are moved toward each other so as to chuck the opposite end faces 7*a*, 7*b* of the log 7.

Then, the electric motor 31 is actuated thereby to rotate the centering spindles 29 and hence to cause the log 7 to be rotated at least one revolution, during which the maximum diameter and minimum diameter (as measured from the center of the centering spindles 29) of the regions of opposite end faces 7*a*, 7*b* and intermediate portion of the log 7 are measured. Then, the CPU 41 is operated so as to perform the processing of the data on these maximum diameter and minimum diameter at each portion of the log 7 and to determine the position of axial centers 7*c* and 7*d* of the opposite end faces 7*a* and 7*b* of the log 7.

Then, according to the signals from the CPU 41, the electric motor 31 is actuated on the basis of the data of the prospective positions of axial centers 7*c* and 7*d* at the opposite end faces 7*a* and 7*b* of log 7 that have been stored in the third memory region 45*c*. As a result, the log 7 is caused to further rotate in such a manner that the virtual line ML3 passing through the prospective axial centers 7*c* and 7*d* of the opposite end faces 7*a* and 7*b* of log 7 passes through the center R of the shaft 51, i.e. the virtual line ML3 is aligned with the virtual line in the radial direction of the shaft 51 (as viewed from the Z direction which is parallel with the axial center line of the centering spindle 29) (see FIG. 14). Concurrently, the CPU 41 is operated so as to calculate the angle θ2 between the virtual line ML2 and the virtual line ML3 under the condition shown in FIG. 14, thereby output a signal, on the basis of which the electric motor 53 is driven to rotate the shaft 51, and hence, to rotate the holders 57 and the holding members 55 from the position shown in FIG. 14 toward the left side. Further, when a detection signal from the rotational angle detector 53*a* indicating that the shaft 51 has been rotated by an angle of θ2 is detected by the CPU 41, a signal is output by the CPU 41 so as to stop the operation of the electric motor 53. As a result of these operations, the virtual line ML2 of the holding members 55 is rendered to agree or align with the aforementioned virtual line ML3 (see FIG. 15).

Next, the first operating member 19 is actuated based on a signal from the CPU 41 so as to move the holders 57 toward each other thereby causing the holding members 55 to hold the opposite end faces 7*a* and 7*b* of the log 7 that has been chucked by the centering spindles 29. Thereafter, the second operating member 35 is allowed to return, and the centering spindles 29 are also moved away from each other, whereby the log 7 is released from the chucking by the centering spindles 29.

Thereafter, based upon the data on each distance between the center R of the shaft 51 to the prospective axial centers 7*c* and 7*d* of the opposite end faces of the log 7 and upon the data of aforementioned "r", the CPU 41 is operated to calculate the magnitude of movement in radial direction of each holding member 55, which is required for make each distance identical with the aforementioned "r". Based on the calculated results, signals are output so as to independently actuate each electric motor 23 thereby to move each holding member 55. When the movement of each holding member 55 to a calculated distance is confirmed by the rotational angle detector 23*a*, a signal is emitted from the CPU 41 so as to stop the operation of each electric motor 23. As a result, the prospective axial centers 7*c* and 7*d* of the opposite end faces of the log 7 which is held by the holding members 55 are positioned on the circular arc having its center at the R of the shaft 51 and passing through the rotational center P of the cutting spindle 9 (FIG. 16).

By the way, the operation of rendering the prospective axial centers 7*c* and 7*d* of the opposite end faces of the log 7 which is held by the holding members 55 to agree or align with the circular arc having its center at the R of the shaft 51 and passing through the rotational center P of the cutting spindle 9 may be performed, as mentioned hereinafter, after or during the rotation of the holder 57 with the log 7 being held by means of the holding members 55.

Figure 16:
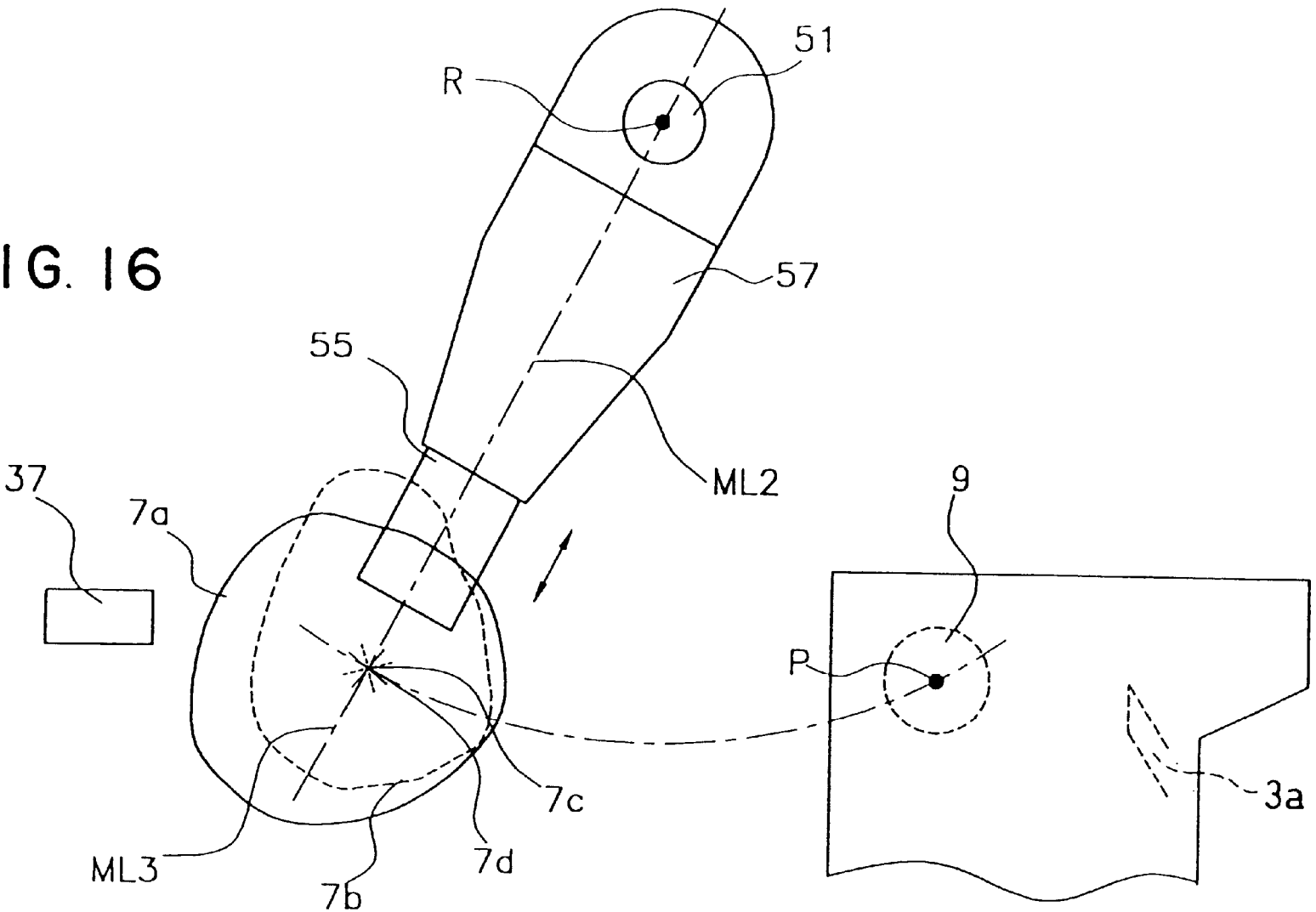
FIG. 16 is an enlarged front view illustrating a centering and feeding mechanism.

Next, the electric motor 53 is driven according to a signal from the CPU 41, thereby to rotate the shaft 51 in counterclockwise and hence, to rotate the holder 57 as shown in FIG. 16. When the rotation of the virtual line ML2 to an angle corresponding to the total angle of θ1 and θ2 is confirmed by the rotational angle detector 23*a*, a signal is emitted from the CPU 41 so as to stop the operation of each electric motor 53. As a result, the holder 57 is positioned such that the virtual line ML2 is aligned with the virtual line ML4 passing through the aforementioned centers R and P, while the prospective axial centers 7*c* and 7*d* of the opposite end faces of the log 7 are aligned with the rotational center P of the cutting spindle 9 (FIG. 17).

Next, a spindle operating member (not shown) is actuated so as to move each cutting spindle 9 toward the opposite end faces 7*a* and 7*b* of the log 7, thereby causing each cutting spindle 9 being press-contacted with the opposite end faces 7*a* and 7*b* of the log 7. As a result, the log 7 is chucked by the cutting spindle 9 with the prospective axial centers 7*c* and 7*d* thereof being aligned with the rotational center P of the cutting spindles 9.

Thereafter, upon receipt of a signal from the CPU 41, the first operating member 19 is caused to return, whereby the log 7 is released from the chucking by the holding members 55, after which each electric motor 53 is actuated to turn the shaft 51 in counterclockwise as shown in FIG. 17. When the rotation of the shaft 51 to an angle of θ1 is confirmed by the rotational angle detector 53*a*, a signal is emitted from the CPU 41 so as to stop the operation of each electric motor 53, thereby causing each holding member 55 to return to the initial position as shown in FIG. 12, thus finishing the centering and feeding operation of the log 7.

Embodiment 4

FIGS. 18 to 21 illustrate the operation of centering and feeding a log.

According to Example 3, the log 7 is caused to rotate by means of the centering spindle 29 at the occasion of rendering the log 7 to be held by the holding members 55 so as to align the virtual line ML3 passing through the prospective axial centers 7*c* and 7*d* of the opposite end faces of the log 7 with the reference virtual line ML2 passing through the center of the holding members 55. Alternatively, after the log 7 is allowed to be held by the holding members 55, the holding members 55 are moved in the direction of the reference virtual line ML2 so as to align the prospective axial centers 7*c* and 7*d* of the opposite end faces of the log 7 with a point on the circular arc having its center at the R of the shaft 51 and passing through the rotational center P of the cutting spindle 9.

By contrast, according to this embodiment (Embodiment 4), the log 7 is caused to rotate by means of the centering spindle 29 at the occasion of rendering the log 7 to be held by the holding members 55 so as to render the virtual line ML3 passing through the prospective axial centers 7*c* and 7*d* of the opposite end faces of the log 7 not to align but to become parallel with the reference virtual line ML2 passing through the center of the holding members 55.

Namely, the holding members 55 are arranged to reciprocatively rotate within a region interposed between the position where the reference virtual line ML2 is displaced by a required angle of a as measured clock-wise from the virtual line ML 5 passing through both of the rotational center S of the centering spindle 29 and the center R of the shaft 51 and the position where the reference virtual line ML2 is displaced by a desired angle as measured counterclockwise from the aforementioned position which is displaced by said required angle of a from the virtual line ML 5. By the way, this required angle of a should be set in a range which makes it possible to hold the log 7 being chucked by the centering spindle 29.

Figure 18:
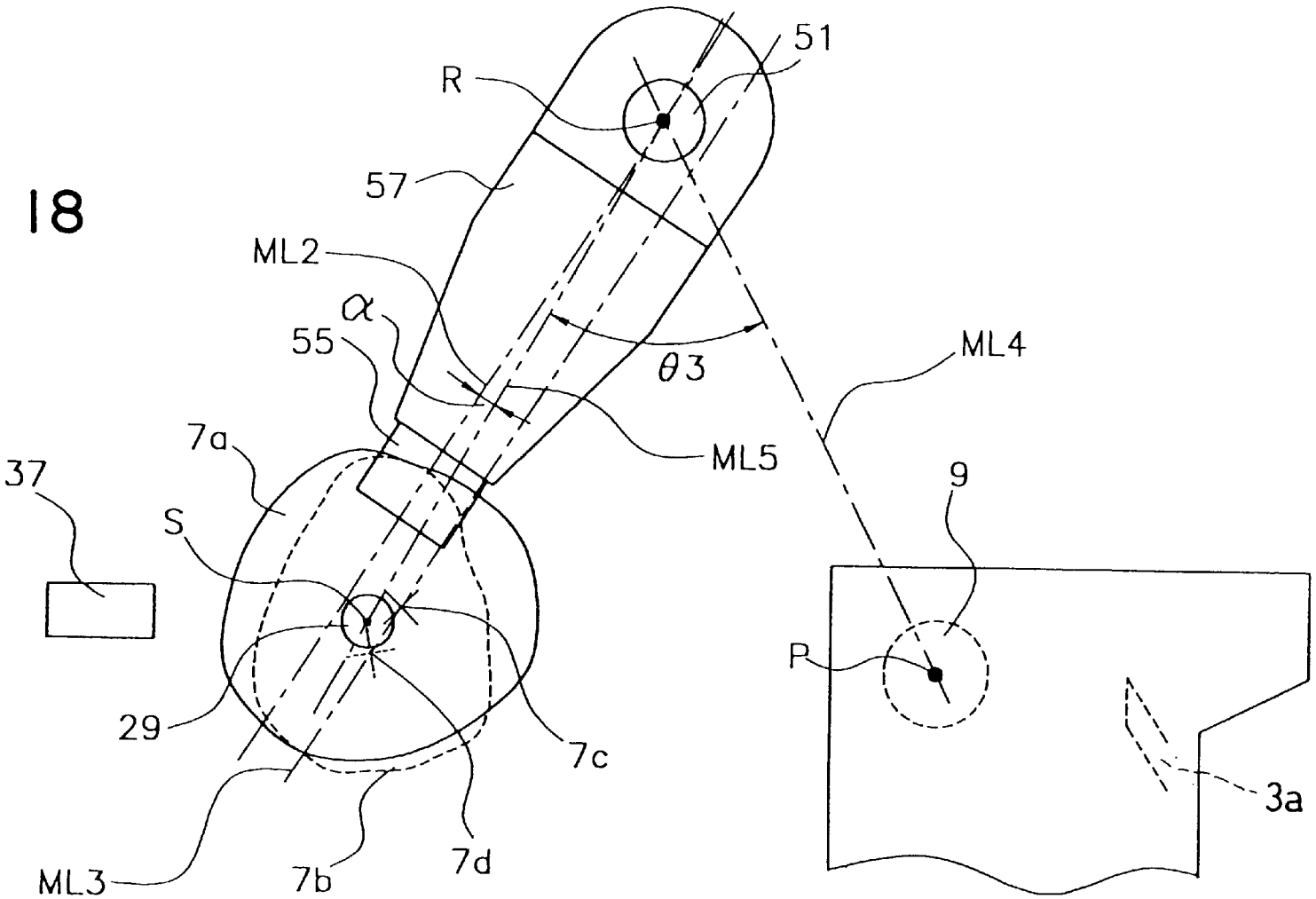
FIG. 18 is an enlarged front view illustrating a centering and feeding mechanism according to a fourth embodiment of the present invention.

By the way, the value of angle θ3 between the virtual line ML4 and the virtual line ML5 shown in FIG. 18 is input, in advance, in the CPU 41.

Then, in the same manner as explained in Embodiment 3, the log 7 is allowed to be chucked by means of the centering spindles 29 and then caused to turn at least one revolution, during which the positions of axial centers 7*c* and 7*d* of the opposite end faces 7*a* and 7*b* of the log 7 are determined through a processing of data. Then, according to the signals from the CPU 41, the electric motor 53 is actuated so as to rotate the shaft 51 in clock-wise from the initial state shown in FIG. 12.

When the rotation of the reference virtual line ML2 that has been set in the holding members 55 to the position which is displaced from the virtual line ML5 by an angle of θ1 is confirmed by the rotational angle detector 53*a* as shown in FIG. 18, a signal is emitted from the CPU 41 so as to stop the operation of each electric motor 53. Thereafter, as shown in FIG. 18, the electric motor 31 is actuated, thereby causing the log 7 held by the centering spindles 29 to rotate such that the virtual line ML3 passing through the prospective axial centers 7*c* and 7*d* of the opposite end faces 7*a* and 7*b* of log 7 is made parallel with the reference virtual line ML2.

By the way, the reference virtual line ML2 that has been set in the holding members 55 at the occasion when the holder 57 is rotated to set in a state of stand-by in the region of centering spindle 29 is always a fixed position as in the cases of the above embodiments. Therefore, after the log 7 is caused to turn by means of the centering spindle 29 so as to determine, through processing, the positions of axial centers 7*c* and 7*d* of the opposite end faces 7*a* and 7*b* of the log 7, the log 7 may be further rotated by means of the centering spindle 29 thereby to render the virtual line ML3 passing through the prospective axial centers 7*c* and 7*d* to become parallel with the reference virtual line ML2.

Then, the first operating member 19 is actuated based on a signal from the CPU 41 so as to move the holding members 55 to hold the opposite end faces 7*a* and 7*b* of the log 7 as in the case of Embodiment 3. Thereafter, the centering spindles 29 are moved away from each other to release the chucking of the log 7.

Figure 19:
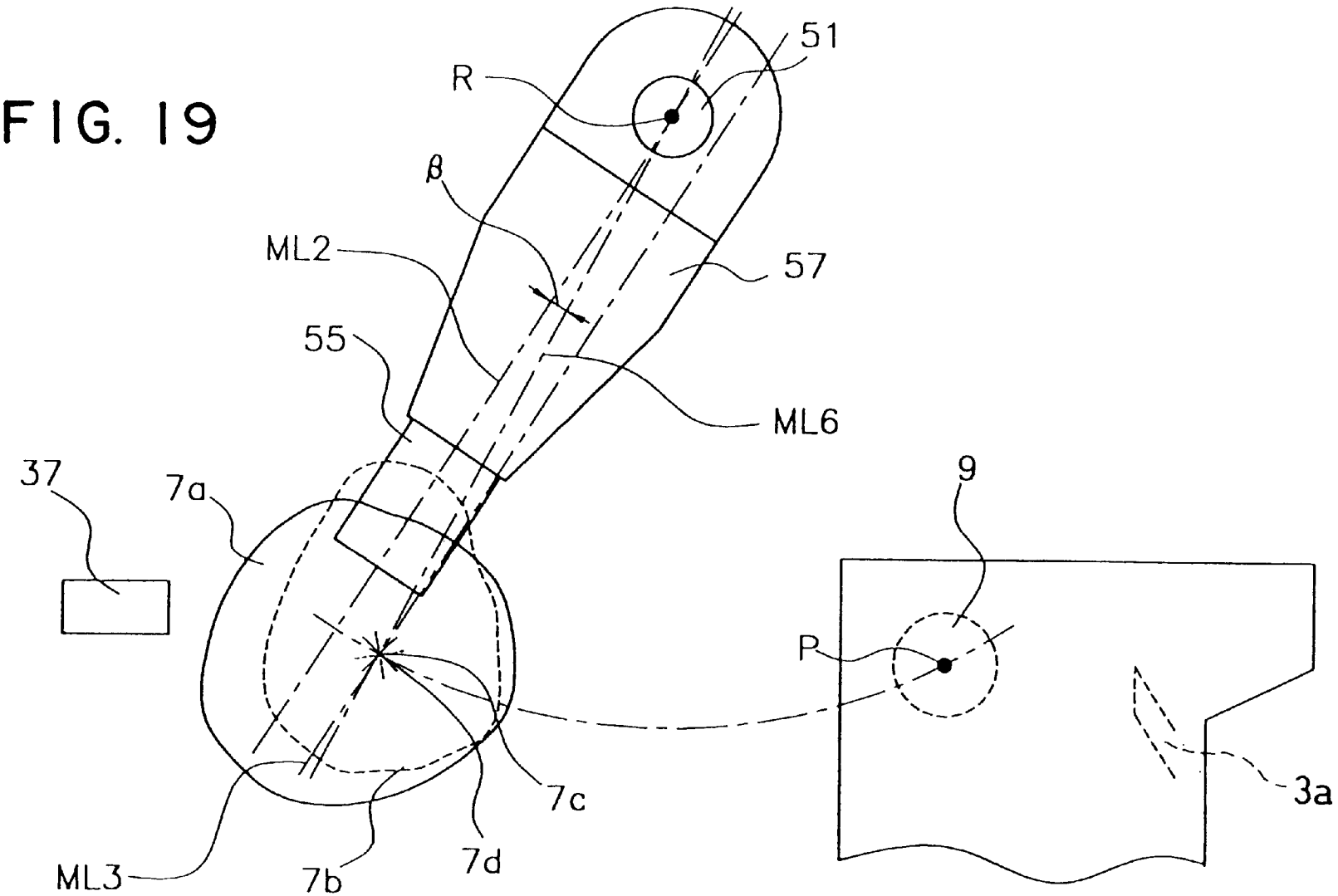
FIG. 19 is an enlarged front view illustrating a centering and feeding mechanism.

Thereafter, based upon the control data that have been obtained through the processing of the data of the positions of the axial centers of the end faces 7*a* and 7*b* of the log 7, each electric motor 23 is actuated and at the same time, the magnitude of movement of the holding members 55 is detected by making use of the rotational angle detector 23*a*. By doing so, the holding member 55 are respectively moved in the radial direction of the shaft 51, and at the same time, the prospective axial centers 7*c* and 7*d* of the opposite end faces of the log 7 which is held by the holding members 55 are positioned on the circular arc having its center at the R of the shaft 51 and passing through the rotational center P of the cutting spindle 9 (FIG. 19).

Further, under this condition, the angle 6 formed between the virtual line ML2 and the virtual line ML6 passing through the axial centers 7*c* and 7*d* and the R is calculated by the CPU 41.

Then, according to the signals from the CPU 41, the electric motor 53 is actuated thereby to rotate the shaft 51 and also to turn the holder 57 in clock-wise.

Figure 20:
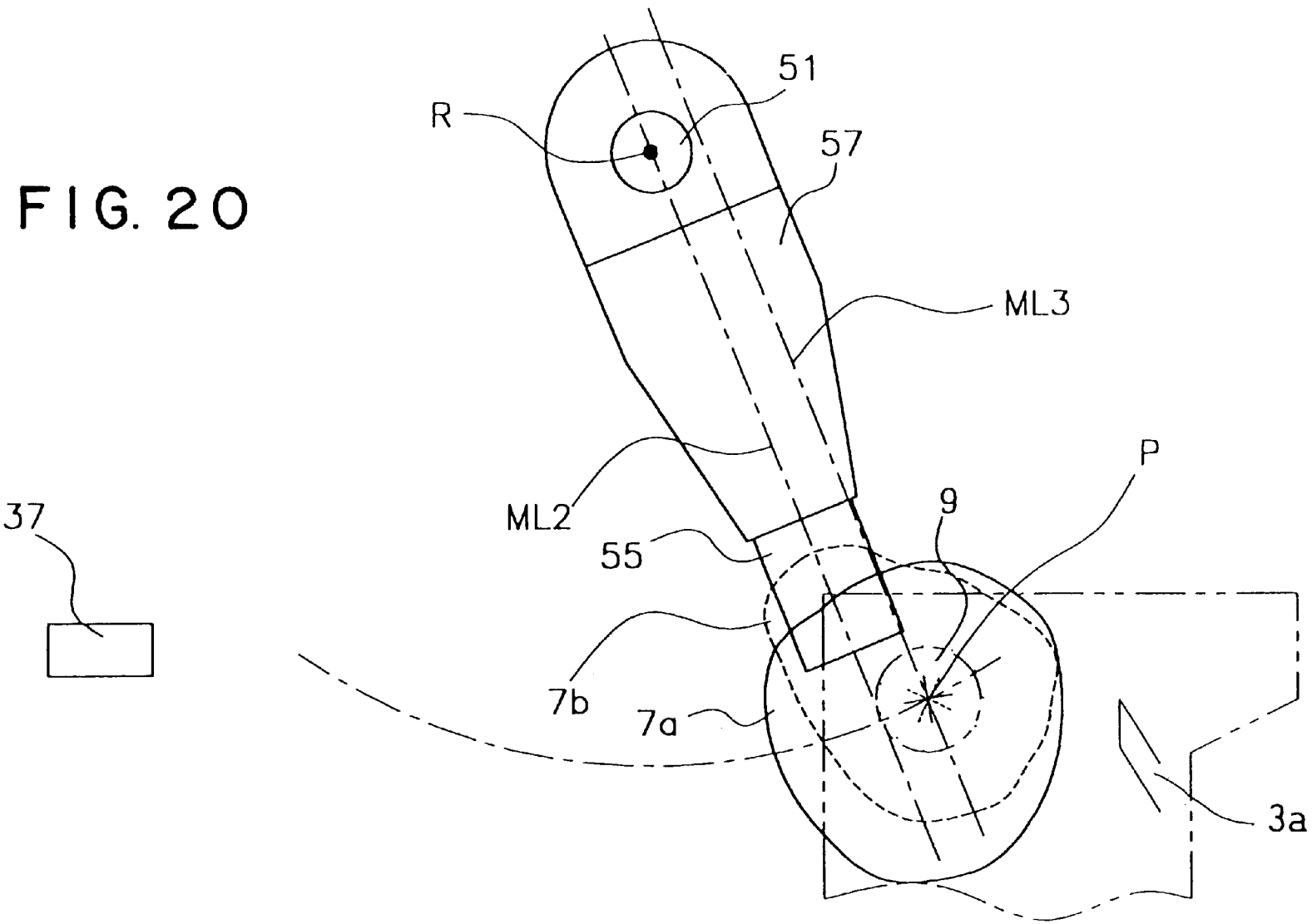
FIG. 20 is an enlarged front view illustrating a centering and feeding mechanism.

When the rotation of the shaft 51 to an angle of α+θ3−β is detected from a signal form the rotational angle detector 53*a*, signal is emitted from the CPU 41 so as to stop the operation of each electric motor 53, and hence, the rotation of the shaft 51 is also stopped. As a result, as shown in FIG. 20, the prospective axial centers 7*c* and 7*d* of the log 7 are aligned with the rotational center P of the cutting spindle 9. Under this condition, the cutting spindle 9 is moved toward the axial center line thereof so as to chuck the log 7.

Figure 21:
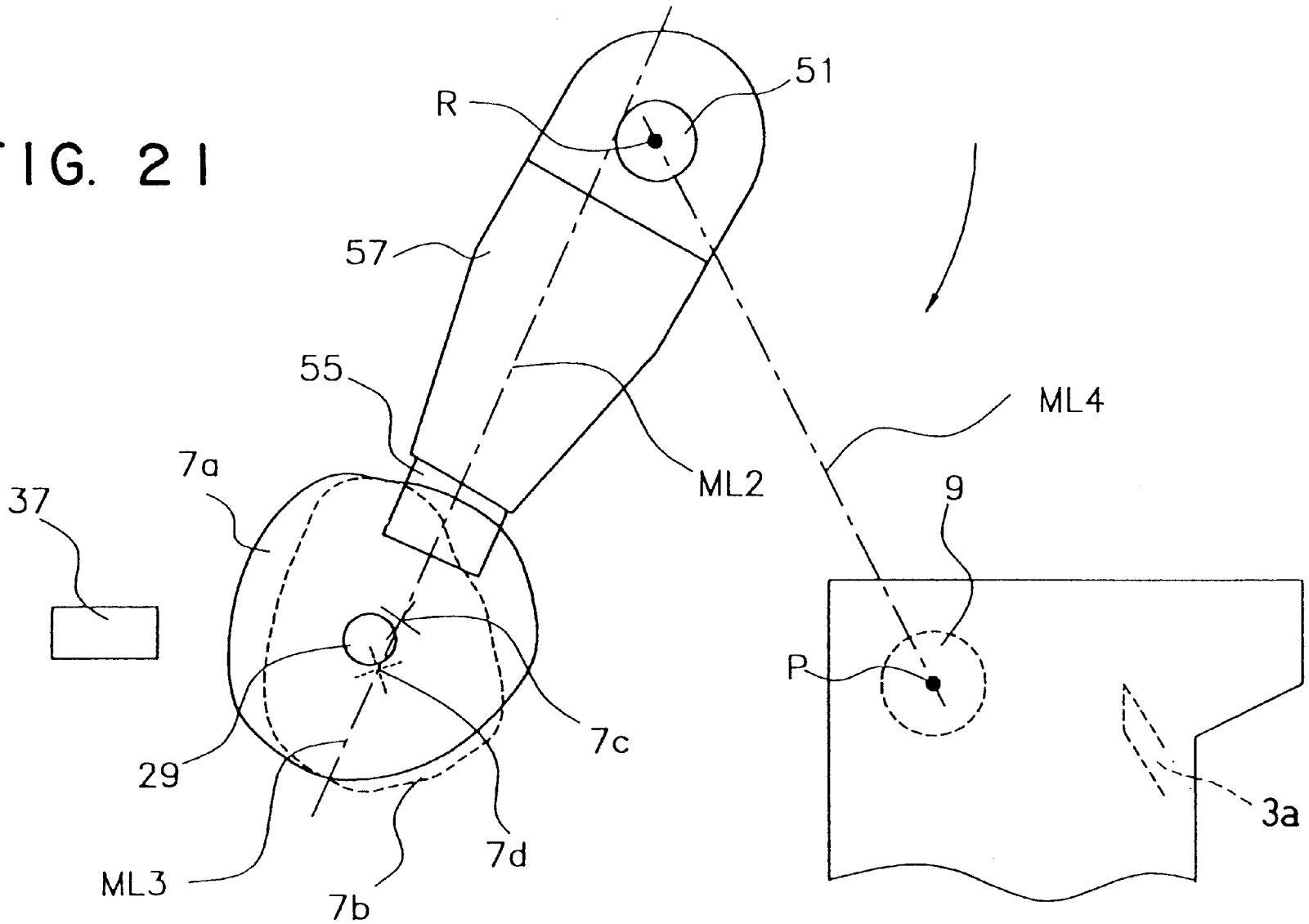
FIG. 21 is an enlarged front view illustrating a centering and feeding mechanism according to a modified embodiment of the present invention.

In Embodiments 3 and 4, the reference virtual line ML2 passing through the center of the holding member 55 is assumed as passing the rotational center R of the shaft 51. However, it is also possible to assume a line which does not pass through the rotational center R of the shaft 51 as shown in FIG. 21, and hence to make the holding members 55 movable, in relative to the holder 57, parallel with the reference virtual line ML2.

Namely, the holding members 55 may be controlled so as to make the reference virtual line ML2 parallel or align with the virtual line ML3 passing through the axial centers 7*c* and 7*d*. Thereafter, based upon the control data that have been obtained through the processing of the data of the positions of the axial centers of the end faces 7*a* and 7*b* of the log 7, each electric motor 23 is actuated and at the same time, the magnitude of movement of the holding members 55 is detected by making use of the rotational angle detector 23*a*. By doing so, the holding member 55 are respectively moved in the radial direction of the shaft 51, and at the same time, the prospective axial centers 7*c* and 7*d* of the opposite end faces of the log 7 are positioned on the circular arc having its center at the R of the shaft 51 and passing through the rotational center P of the cutting spindle 9.

Then, the angle formed between the virtual line ML4 and the virtual line passing through the axial centers 7*c* and the R is calculated by the CPU 41. Then, the shaft 51 is rotated counterclock-wise by an angle calculated in this manner. Thereafter, the log is chucked by means of the cutting spindles 9 in the same manner as mentioned above.

Figure 14:
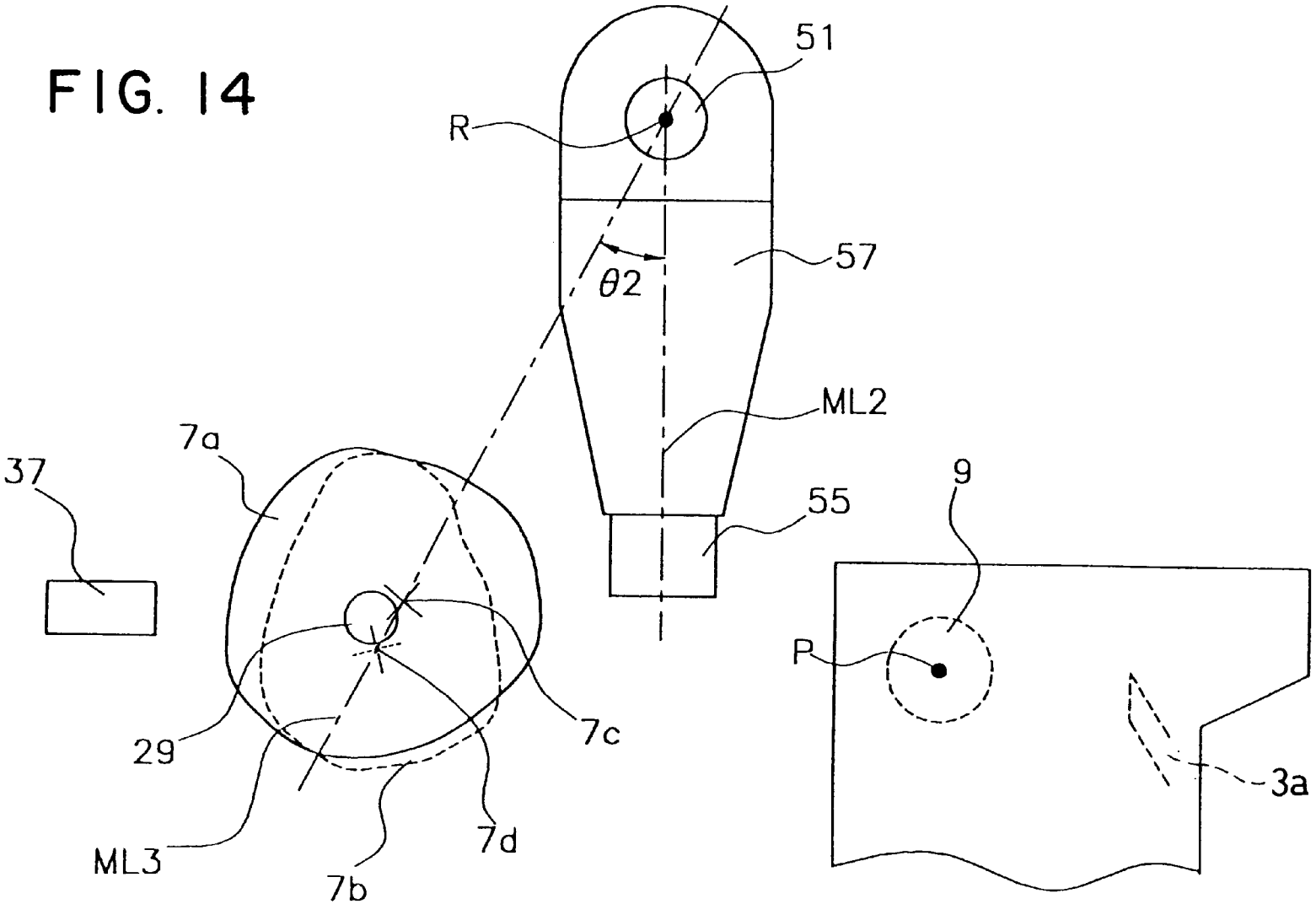
FIG. 14 is an enlarged front view illustrating a centering and feeding mechanism.
Figure 15:
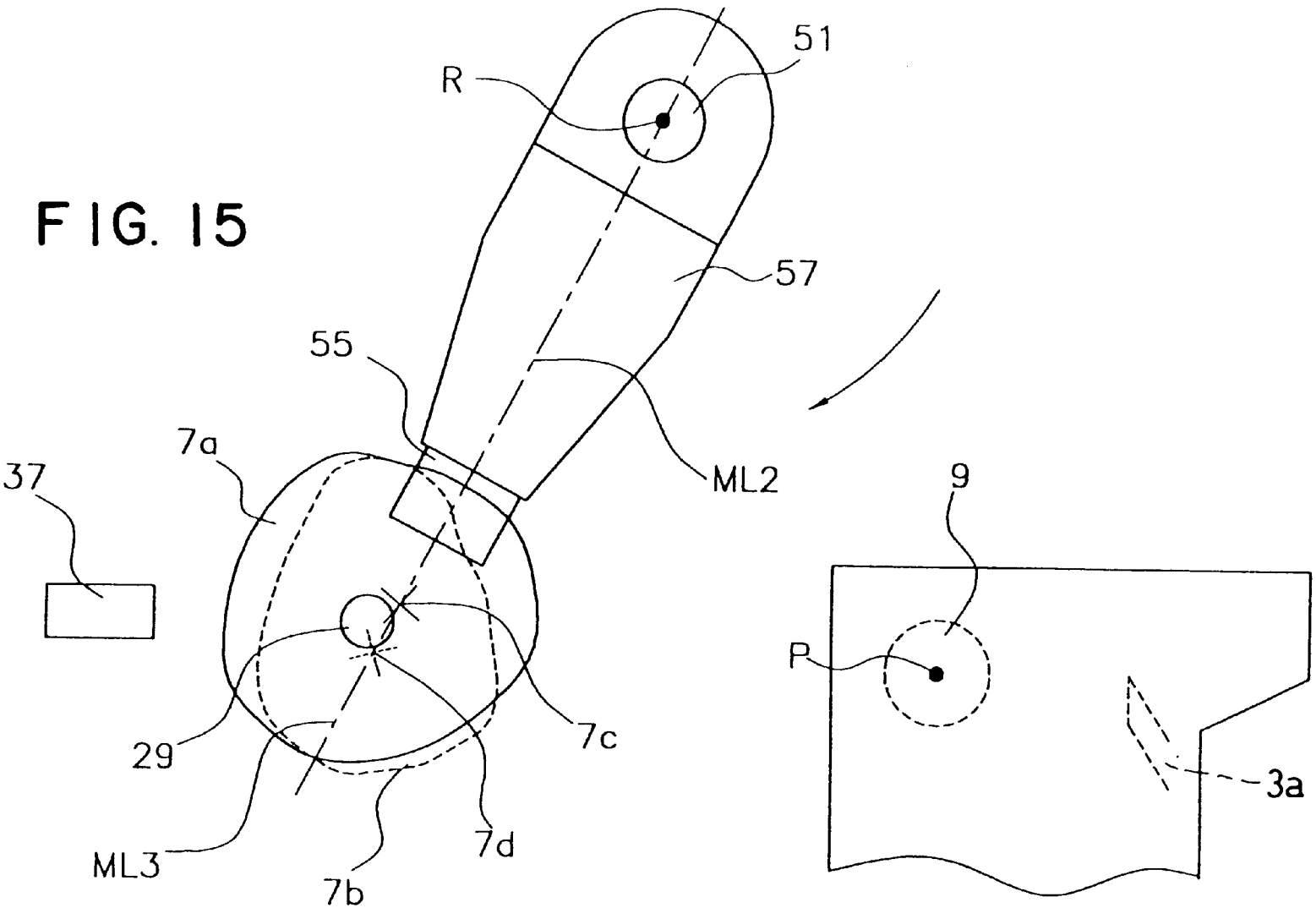
FIG. 15 is an enlarged front view illustrating a centering and feeding mechanism.

By the way, there is known another type of veneer lathe which is constructed such that a back-up roll to be press-contacted with the circumferential surface of log for preventing the deflection of log during the peeling of the log, and a device for supporting and moving the back-up roll are interposed between the cutting spindle 9 and the centering spindle 29 of the apparatus of Embodiment 3 shown in FIG. 14 for instance.

If the holder 57 is rotated from the position shown in FIG. 16 to the position shown in FIG. 17 in such a veneer lathe, the log 7 may be contacted with the back-up roll, etc.

Therefore, it may be required in such a veneer lathe that a device composed of the shaft 51, the holding members 55, the holders 57, etc. for moving a log from the centering spindle 29 to the cutting spindle 9 is positioned at an upper portion of the apparatus shown in FIG. 14, i.e. at a portion which is far over the centering spindle 29 and cutting spindle 9. It may be also required that the moving distance of the holding members 55 in the direction of the virtual line ML2 in relative to the holder 57 is made sufficiently longer so as to make it possible for the holding members 55 to hold the log 7 being chucked by the centering spindle 29, and at the same time, the log held by the holding members 55 can be fed to a predetermined portion of the cutting spindle 9 even if the aforementioned device is disposed at an upper portion of the apparatus.

This apparatus may be operated as follows. Namely, in the same manner as the apparatus of Embodiment 3 shown in FIG. 15, a log 7 which is being chucked using the centering spindle 29 under the condition where the virtual line ML3 passing through the axial centers 7*a* and 7*b* is aligned with the center R of the shaft 51 is allowed to be held by the holding members 55 which is being sufficiently extended in the direction of the virtual line ML2 in relative to the holder 57. Then, after the centering spindles 29 are moved away from the log 7, the holding members 55 are moved back in the direction of the virtual line ML2 toward the center R of the shaft 51 and to such an extent that even if the shaft 51 is turned toward the cutting spindle 9, the log 7 is prevented from being contacted with the back-up roll, etc. Then, the shaft 51 is continued to be rotated until the rotational center P of the cutting spindle 9 is aligned with the virtual line ML2 of the holding members 55. Upon finishing the rotation of the shaft 51, the holding members 55 are extended in the direction of each virtual line ML2 until the axial centers 7*c* and 7*d* of the log 7 are aligned with the aforementioned rotational center P. After the movement of each holding member 55 is stopped, the cutting spindles 9 are moved toward the log 7 so as to chuck the log 7.

In the cases of Embodiments 1 and 2 also, after the log 7 is held by the holding members 21 with the virtual line ML1 passing the axial centers 7*c* and 7*d* being orientated in the vertical direction, the holding members 21 are moved back in the direction of the virtual line VL1 toward an upper portion of the apparatus to such an extent that even if the holder 17 is moved toward the cutting spindle 9, the log 7 is prevented from being contacted with the back-up roll, etc. Then, the holder 17 is moved until the virtual line ML1 is aligned with the rotational center P of the cutting spindle 9. Upon finishing the movement of the holder 17, the holding members 21 are extended in the direction of each virtual line VL1 until the axial centers 7*c* and 7*d* of the log 7 are aligned with the aforementioned rotational center P. After the movement of each holding member 21 is stopped, the cutting spindles 9 are moved toward the log 7 so as to chuck the log 7.

In Embodiments 1 to 4, although the log 7 is fed to the cutting spindle of a veneer lathe employed as a working machine, the log 7 may be fed to a working machine such as an apparatus provided with a cutter 59 as explained below.

Namely, the log 7 is often partially accompanied with radially projected portions which are protruded from the surface of the log 7 due to an influence of knots, so that if the log 7 is turned or cut as it is by means of a veneer lathe, the following problems are raised. Namely, in the turning of such a log, only the projected portions are turned by a cutter in the initial stage of turning. The veneer thus produced is useless due to an insufficiency in the orientation of fibers. This useless turning operation of veneer is required to be continued until the projected portions are completely cut off, thus deteriorating the productivity of veneer using a veneer lathe.

Figure 22:
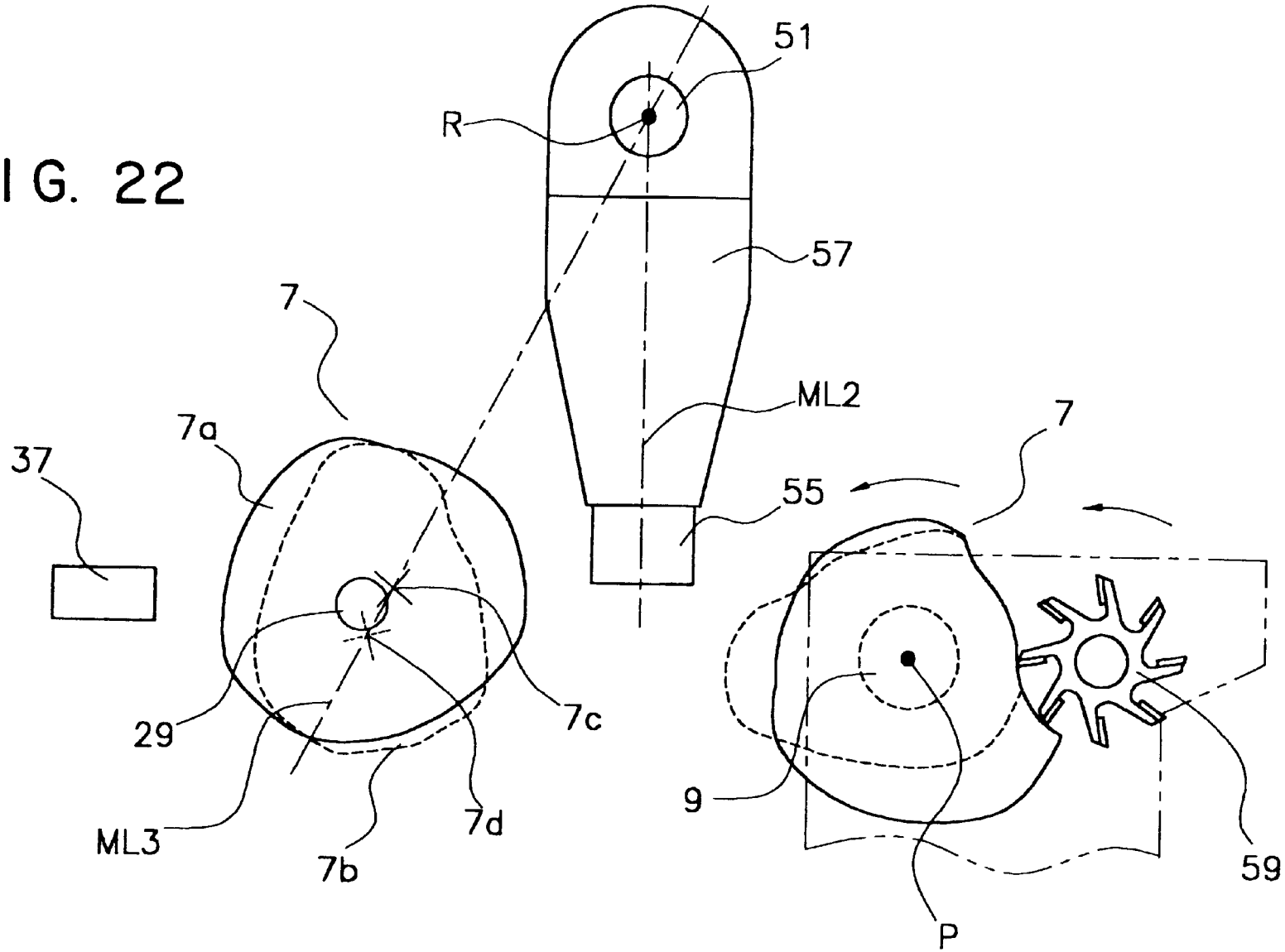
FIG. 22 is a front view schematically illustrating a centering and feeding mechanism wherein a cutter is employed as a working machine.
Figure 23:
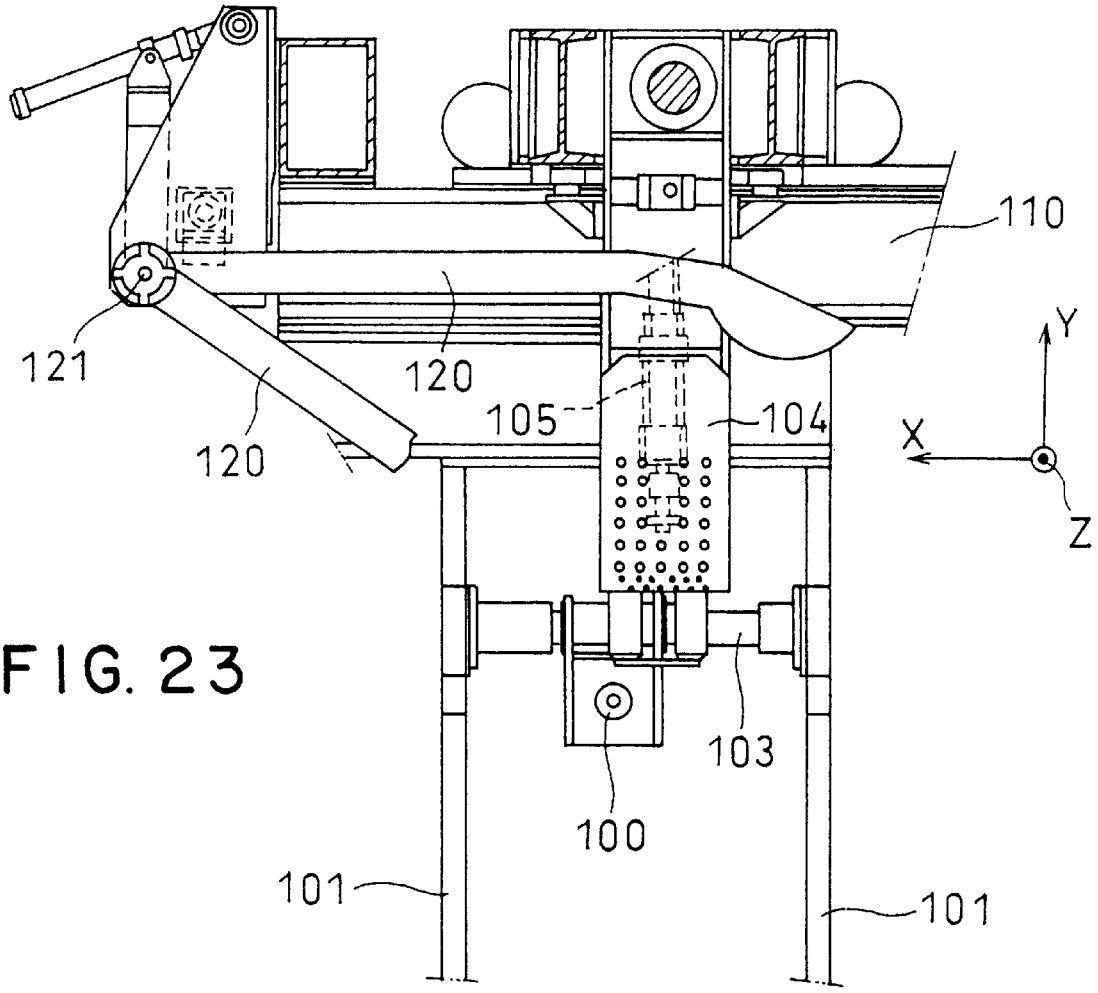
FIG. 23 is a from view illustrating one example of the conventional log centering apparatus.

Therefore, such a log may be treated at first by a working machine provided with a cutter as shown in FIG. 22. Namely, in the same manner as illustrated with reference to Embodiments 1 to 4, the log 7 is allowed to be chucked by a cutting spindle 9 in such a manner that the axial center 7*c* and 7*d* of the log 7 are aligned with the rotational center P of the cutting spindle 9 of the working machine. Then, the cutting spindle 9 is rotated in the direction indicated by the arrow and at the same time, reciprocatively moved in the radial direction of the log 7 while allowing the log 7 to rotate in the direction indicated by the allow, thereby cutting out the projected portions of the log 7.

In this case, the reciprocative movement of the cutting spindle 9 in the radial direction of the log 7 may be performed manually by an operator, or may be automatically performed by a control signal to be transmitted from the control means on the basis of information to be derived from the employment of the log center detectors 37 as explained with reference to Embodiment 1.

If the log 7 which is preliminarily turned to remove the projected portions in this manner by a working machined provided with a cutter is then turned or cut by means of a veneer lathe, the time loss required for turning the useless veneer by making use of the veneer lathe can be minimized, thus making it possible to improve the productivity of veneer in the employment of a veneer lathe.

Therefore, it is possible according to the present invention to omit the conventional exclusive x-axis adjustor, to miniaturize the apparatus, and to simplify the structure of the apparatus, thus making it possible to save the manufacturing cost of the apparatus.

What is claimed is:

1. A log centering and feeding apparatus which is designed to be employed in combination with a working machine provided at least with a cutting spindle having an axial center in the direction of Z for chucking a log, said log centering and feeding apparatus being used for feeding the log to the cutting spindle under a condition where the centering of the log has been determined; said log centering and feeding apparatus comprising;

a centering spindle disposed away from the cutting spindle by a predetermined distance in the direction of X and having an axial center in the same Z direction as that of said cutting spindle;

log center detecting means for detecting the position of axial center of the log under a condition where the log is kept chucked by said centering spindle;

a pair of log transporting members which are rendered movable in the direction of Z as well as in the direction of Y including a component orthogonally intersecting the direction of Z thereby enabling the log transporting members to receive the log from said centering spindle and to deliver the log to said cutting spindle; and control means for controlling the operation of each log transporting member;

wherein said log transporting members are provided with a setting of reference virtual line in the direction of Y; and said control means comprises;

means for forcing the centering spindle holding the log to rotate at least one revolution thereby enabling said log center detecting means to determine, through processing, each position of axial center which is assumed to constitute the axial centers at both end faces of the log;

means for further rotating the centering spindle so as to make the direction of the virtual line passing through every positions of axial centers as viewed from the direction of Z agree or parallel with the reference virtual line that has been set in advance to the pair of the log transporting members;

means for controlling said pair of log transporting members, after the log has been transferred from said centering spindle to said log transporting members while maintaining the directions of said virtual lines in agreement or parallel with each other, in such a manner that each center position of the log that has already been kept in place in the direction of X where the virtual line passing through said axial center of the log is made in agreement with the axial center line of said cutting spindle can be made in agreement with the direction of Z constituting the axial center line of said cutting spindle; and means for controlling said log transporting members in a manner to allow said log to be chucked from said log transporting members to said cutting spindle while the state of the log adjusted in the direction of Z is maintained, thereby making it possible to feed the log in an axially centered state thereof to the cutting spindle.

2. The log centering and feeding apparatus according to claim 1, wherein each of said pair of log transporting members comprise a holder which is movable in the direction of Z, and a holding member mounted on said holder and rendered movable in the direction of the reference virtual line in relative to said movable holder.

3. The log centering and feeding apparatus according to claim 2, wherein said reference virtual line of said pair of log transporting members is set on the basis of said holding member.

4. The log centering and feeding apparatus according to claim 2, wherein said pair of log transporting members are permitted to linearly and reciprocatively move in the direction of X.

5. The log centering and feeding apparatus according to claim 2, wherein said pair of log transporting members are permitted to rotate about a given point.

6. A log centering and feeding apparatus which is designed to be employed in combination with a working machine for turning a log while chucking the log by means of cutting spindles thereby to produce a veneer, said log centering and feeding apparatus comprising;

a pair of centering spindles facing to each other, each being made rotatable at a place distanced away from the cutting spindles by a predetermined distance and movable in the direction of Z which is parallel with an axial center line of said cutting spindles;

a plurality of log center detecting means for detecting the position of axial center of the log, said plurality of log center detecting means being disposed along the Z direction in relative to the log chucked by said centering spindle;

a movable frame which is linearly and reciprocatively movable in the direction of X including a component of direction between a predetermined position of said cutting spindle or a position where a reference virtual line of holding members to be mentioned later passes through the axial center line of said butting spindle and a given position of said centering spindle;

a pair of holding members which are mounted on said movable frame and rendered movable in the direction of Z in relative to said movable frame as well as in the direction of Y including a component orthogonally intersecting the direction of Z, said pair of holding members being assigned with a reference virtual line which is parallel with said Y direction; and control means for controlling the operation of each holding member;

wherein said control means is designed to be operated such that;

the centering spindle holding the log is caused to rotate at least one revolution thereby enabling said log center detecting means to determine, through processing, each position of axial center which is assumed to constitute the axial centers at both end faces of the log;

the centering spindles are further rotated so as to make the virtual line passing through every positions of axial centers as viewed from the direction of Z parallel with the Y direction, and at the same time, a distance in the X direction between a waiting position of said movable frame and a virtual line passing through every positions of axial centers is calculated to obtain a value, on the basis of which said movable is moved until the reference virtual line of said holding members is rendered to agree with said virtual line passing through every positions of axial centers;

said holding members are moved in the Z direction so as to render said holding members to come close to each other thereby to permit both end faces of said log to be held between said holding members, after which the chucking of said log by said centering spindles are released;

said movable frame is moved in the X direction until the reference virtual line of said holding member is aligned with the axial center line of said cutting spindle, and said holding members are moved in the Y direction in relative to said movable frame during or after said movable frame is moved in the X direction, thereby enabling every positions of axial centers to become aligned with the rotational center of said cutting spindle; and said log is then allowed to be chucked by said cutting spindle.

7. A log centering and feeding apparatus which is designed to be employed in combination with a working machine for turning a log while chucking the log by means of cutting spindles thereby to produce a veneer, said log centering and feeding apparatus comprising;

a pair of centering spindles facing to each other, each being made rotatable at a place distanced away from the cutting spindles by a predetermined distance and movable in the direction of Z which is parallel with an axial center line of said cutting spindles;

a plurality of log center detecting means for detecting the position of axial center of the log, said plurality of log center detecting means being disposed along the Z direction in relative to the log chucked by said centering spindle;

a movable frame which is linearly and reciprocatively movable in the direction of X including a component of direction between a given position of said cutting spindle and a predetermined position of said centering spindles or a position where a reference virtual line of holding members to be mentioned later displaced from the axial center line of said cutting spindle by a predetermined distance;

a pair of holding members which are mounted on said movable frame and rendered movable in the direction of Z in relative to said movable frame as well as in the direction of Y including a component orthogonally intersecting the direction of Z, said pair of holding members being assigned with a reference virtual line which is parallel with said Y direction; and control means for controlling the operation of each holding member;

wherein said control means is designed to be operated such that;

the centering spindle holding the log is caused to rotate at least one revolution at the latest before the holding members of said movable frame which have been moved to a predetermined position in the vicinity of the centering spindle are permitted to hold both end faces of the log, thereby enabling said log center detecting means to determine, through processing, each position of axial center which is assumed to constitute the axial centers at both end faces of the log;

the centering spindles are further rotated so as to make the virtual line passing through every positions of axial centers as viewed from the direction of Z parallel with the Y direction, and at the same time, a distance between a virtual line passing through every positions of axial centers which is parallel with the Y direction and the axial center line of the cutting spindle is calculated;

said holding members are moved in the Z direction so as to permit both end faces of said log to be held between said holding members, after which the chucking of said log by said centering spindles are released;

said movable frame is moved in the X direction until the reference virtual line of said holding member is moved to a distance that has been determined by the aforementioned processing, and said holding members are moved in the Y direction in relative to said movable frame during or after said movable frame is moved in the X direction, thereby enabling every positions of axial centers to become aligned with the rotational center of said cutting spindle; and said log is then allowed to be chucked by said cutting spindle.

8. A log centering and feeding apparatus which is designed to be employed in combination with a working machine for turning a log while chucking the log by means of cutting spindles thereby to produce a veneer, said log centering and feeding apparatus comprising;

a pair of centering spindles facing to each other, each being made rotatable at a place distanced away from the cutting spindles by a predetermined distance and movable in the direction of Z which is parallel with an axial center line of said cutting spindles;

a plurality of log center detecting means for detecting the position of axial center of the log, said plurality of log center detecting means being disposed along the Z direction in relative to the log chucked by said centering spindle;

a rotatable frame which is rotatable about a given point;

a pair of holding members which are mounted on said rotatable frame and rendered movable in the direction of Z in relative to said rotatable frame as well as in a predetermined radial direction from a rotational center of said rotatable frame, said pair of holding members being assigned with a reference virtual line in conformity with said radial direction; and control means for controlling the operation of each holding member;

wherein said control means is designed to be operated such that;

the centering spindle holding the log is caused to rotate at least one revolution thereby enabling said log center detecting means to determine, through processing, each position of axial center which is assumed to constitute the axial centers at both end faces of the log;

the centering spindles are further rotated so as to align the virtual line passing through every positions of axial centers as viewed from the direction of Z with said rotational center;

the rotatable frame is further rotated until the reference virtual line of said holding members is aligned with a virtual line passing through every positions of axial centers;

said holding members are moved in the Z direction so as to render said holding members to come close to each other thereby to permit both end faces of said log to be held between said holding members, after which the chucking of said log by said centering spindles are released;

said rotatable frame is rotated until the reference virtual line of said holding member is aligned with the axial center line of said cutting spindle, and said holding members are moved in said radial direction, thereby enabling every positions of axial centers to become aligned with the rotational center of said cutting spindle; and said log is then allowed to be chucked by said cutting spindle.

9. A log centering and feeding apparatus which is designed to be employed in combination with a working machine for turning a log while chucking the log by means of cutting spindles thereby to produce a veneer, said log centering and feeding apparatus comprising;

a pair of centering spindles facing to each other, each being made rotatable at a place distanced away from the cutting spindles by a predetermined distance and movable in the direction of Z which is parallel with an axial center line of said cutting spindles;

a plurality of log center detecting means for detecting the position of axial center of the log, said plurality of log center detecting means being disposed along the Z direction in relative to the log chucked by said centering spindle;

a rotatable frame which is rotatable about a given point and in a range between a position where a reference virtual line of holding members to be mentioned later is inclined toward the centering spindle by a predetermined angle in relative to a first virtual line connecting a rotational center with the axial center line of said cutting spindle and a position where the reference virtual line is inclined at a desired angle toward the first virtual line from said predetermined angle;

a pair of holding members which are mounted on said rotatable frame and rendered movable in the direction of Z in relative to said rotatable frame as well as in a predetermined radial direction from a rotational center of said rotatable frame, said pair of holding members being assigned with a reference virtual line in conformity with said radial direction; and control means for controlling the operation of each holding member;

wherein said control means is designed to be operated such that;

the centering spindle holding the log is caused to rotate at least one revolution at the latest before the holding members of said holder are moved toward each other so as to hold both end faces of the log after the rotatable frame is rotated to stand by at a position where the reference virtual line of the holding members is turned to a predetermined angle, thereby enabling said log center detecting means to determine, through processing, each position of axial center which is assumed to constitute the axial centers at both end faces of the log;

the centering spindles are further rotated so as to render the virtual line passing through every positions of axial centers as viewed from the direction of Z to become parallel with the reference virtual line;

further, a distance between a virtual line passing through every positions of axial centers and the reference virtual line is calculated;

said holding members are then moved toward each other in the Z direction so as to permit both end faces of said log to be held between said holding members, after which the chucking of said log by said centering spindles are released;

said rotatable frame is then moved toward said cutting spindle and at the same time, said holding members are moved in the radial direction, thereby enabling every positions of axial centers to become aligned with the rotational center of said cutting spindle; and said log is then allowed to be chucked by said cutting spindle.

10. The log centering and feeding apparatus according to any one of claims 1 to 9, wherein said working machine is a veneer lathe.

11. The log centering and feeding apparatus according to any one of claims 1 to 9, wherein said working machine is a log-cutting apparatus provided with a cutter.

12. A method of centering and feeding a log, which comprises the steps of:

determining, through processing by making use of log center detecting means, each position of axial center which is assumed to constitute the axial centers at both end faces of the log by forcing the centering spindle to rotate at least one revolution while both ends of the log are kept chucked with a pair of centering spindles;

further rotating the pair of centering spindles until the virtual line passing through the positions of axial centers as viewed from the direction of Z parallel with the axial center line of the centering spindle is aligned with a predetermined position in the direction of Y;

moving a pair of holding members in the direction of Z and close to both end faces of the log thereby to hold the log with the holding members;

moving said centering spindles away from each end face of the log;

integrally moving said pair of holding members in the direction of X including a directional component extending from said centering spindle to a cutting spindle of a working machine for turning the log until the log is chucked by said cutting spindle; and moving said holding members respectively in the direction of Y thereby rendering each position of axial center at both end faces of the log to become in agreement with the rotational center of said cutting spindle.

13. The log centering and feeding apparatus according to claim 1, wherein said pair of log transporting members are permitted to linearly and reciprocatively move in the direction of X.

14. The log centering and feeding apparatus according to claim 13, wherein said working machine is a veneer lathe.

15. The log centering and feeding apparatus according to claim 13, wherein said working machine is a log-cutting apparatus provided with a cutter.

16. The log centering and feeding apparatus according to claim 1, wherein said pair of log transporting members are permitted to rotate about a given point.

17. The log centering and feeding apparatus according to claim 16, wherein said working machine is a veneer lathe.

18. The log centering and feeding apparatus according to claim 16, wherein said working machine is a log-cutting apparatus provided with a cutter.

* * * * *